US012043998B2

(12) United States Patent
Hofmeister et al.

(10) Patent No.: US 12,043,998 B2
(45) Date of Patent: Jul. 23, 2024

(54) DISPOSER MOUNTING SYSTEM AND METHOD

(71) Applicant: INSINKEREATOR LLC, Benton Harbor, MI (US)

(72) Inventors: Dane T. Hofmeister, Mount Pleasant, WI (US); Eric J. Obermeyer, Franklin, WI (US)

(73) Assignee: INSINKERATOR LLC, Benton Harbor, MI (US)

( * ) Notice: Subject to any disclaimer, the term of this patent is extended or adjusted under 35 U.S.C. 154(b) by 396 days.

(21) Appl. No.: 17/612,493

(22) PCT Filed: May 21, 2020

(86) PCT No.: PCT/US2020/034072

§ 371 (c)(1),
(2) Date: Nov. 18, 2021

(87) PCT Pub. No.: WO2020/237091

PCT Pub. Date: Nov. 26, 2020

(65) Prior Publication Data

US 2022/0162839 A1 May 26, 2022

Related U.S. Application Data

(60) Provisional application No. 62/852,040, filed on May 23, 2019.

(51) Int. Cl.
*E03C 1/266* (2006.01)

(52) U.S. Cl.
CPC ..... *E03C 1/266* (2013.01)

(58) Field of Classification Search
CPC ..... E03C 1/266; E03C 1/2665
See application file for complete search history.

(56) References Cited

U.S. PATENT DOCUMENTS 2,939,639 A 6/1960 Coss
2,975,986 A 3/1961 Frank
(Continued)

FOREIGN PATENT DOCUMENTS

CN 101702925 5/2010
CN 205894194 1/2017
(Continued)

OTHER PUBLICATIONS

Chinese Office Action dated Feb. 10, 2023 for CN Patent Application No. 2020800463261 (7 pages including English Summary).
(Continued)

*Primary Examiner* — Erin Deery
(74) *Attorney, Agent, or Firm* — Amundsen Davis, LLC

(57) ABSTRACT

Mounting systems for waste disposers such as food waste disposers, waste disposers employing such systems, and related methods are disclosed herein. In one example embodiment, a mounting system includes a tubular structure extending between first and second ends, and an enclosure structure having an additional end, where the enclosure structure is configured to be able to support, at least indirectly, the waste disposer. Further, the mounting system includes an elastomeric member extending between the second end and the additional end, where the elastomeric member is coupled to each of, and serves to couple, the tubular structure and the enclosure structure. Additionally, the mounting system includes a plurality of backup linkage members, where each of the plurality of backup linkage members couples at least indirectly, and is integrally formed or molded with at least one of, the tubular structure and the enclosure structure.

20 Claims, 9 Drawing Sheets

(56) References Cited

U.S. PATENT DOCUMENTS

| | | | | |
|---|---|---|---|---|
| 3,069,697 | A | 12/1962 | Brucken et al. | |
| 3,419,224 | A | 12/1968 | Mlinar | |
| 3,432,108 | A | 3/1969 | Enright | |
| 3,862,720 | A | 1/1975 | Guth | |
| 4,310,933 | A | 1/1982 | Stratman | |
| 5,924,635 | A | 7/1999 | Koshimizu et al. | |
| 6,719,228 | B2 | 4/2004 | Berger et al. | |
| 7,021,574 | B2 | 4/2006 | Berger et al. | |
| 7,066,415 | B2 | 6/2006 | Strutz | |
| 7,584,915 | B2 | 9/2009 | Jara-Almonte et al. | |
| 8,424,123 | B2 * | 4/2013 | Svensson | E03C 1/266 241/46.016 |
| 2004/0195409 | A1 | 10/2004 | Berger et al. | |
| 2010/0095444 | A1 | 4/2010 | Sullivan | |
| 2018/0178360 | A1 | 6/2018 | Shields | |

FOREIGN PATENT DOCUMENTS

| | | | |
|---|---|---|---|
| CN | 206090743 | | 4/2017 |
| CN | 108837932 | | 11/2018 |
| CN | 106944200 | | 2/2019 |
| CN | 214574376 | | 11/2021 |
| JP | 2001205130 | | 7/2001 |
| JP | 2003275612 | | 9/2003 |
| JP | 2002119881 | | 4/2004 |
| JP | 2004237152 | | 8/2004 |
| JP | 2004344861 | | 12/2004 |
| JP | 2005034721 | | 2/2005 |
| JP | 3869805 | B2 | 1/2007 |
| JP | 3190523 | | 4/2014 |
| KR | 200366475 | | 11/2004 |
| WO | 2008/091676 | | 7/2008 |
| WO | 2018/118116 | | 6/2018 |
| WO | 2020/237091 | | 11/2020 |

OTHER PUBLICATIONS

PCT/US2020/034072 International Search Report and Written Opinion of the International Searching Authority dated Sep. 16, 2020 (11 pages).

* cited by examiner

DISPOSER MOUNTING SYSTEM AND METHOD

FIELD

The present disclosure relates to waste disposers such as food waste disposers and methods of mounting such waste disposers in relation to other structures such as sinks and, more particularly, to waste disposer assemblies or mounting assemblies of or for such waste disposers, and methods of mounting such waste disposers in relation to other structures such as sinks, by way of such waste disposer assemblies or mounting assemblies.

BACKGROUND

Food waste disposers are used to comminute food scraps into particles small enough to pass through household drain plumbing. Referring to FIG. 1 (Prior Art), a conventional food waste disposer 10 is often mounted to a sink, such as a kitchen sink (not shown), and includes a food conveying section 12, a motor section 14, and a grinding section 16 disposed between the food conveying section and the motor section. The food conveying section 12 includes a housing 18 that forms an inlet for receiving food waste and water. The food conveying section 12 conveys the food waste to the grinding section 16, and the motor section 14 includes a motor imparting rotational movement to a motor shaft to operate the grinding section.

Conventional food waste disposers such as the food waste disposer 10 can be installed to a sink in a two-step procedure using a mounting assembly 100, an example of which is shown in FIG. 1 in an exploded manner relative to the food waste disposer. First, a sink flange assembly 102, which includes a sink (or strainer) flange 104, a sink gasket 106, a back-up flange 108, an upper mounting flange 110, bolts 112, and a retaining ring 114 are installed or mounted in relation to the sink (which again is not shown in FIG. 1). Second, a disposer assembly 30 including the food waste disposer 10 and also including a mounting (or sealing) gasket 116 and a lower mounting flange 118 are attached to the sink flange assembly 102. The combination of the disposer assembly 30 and the mounting assembly 100 can be considered to constitute an overall food waste disposer assembly 150.

More particularly with respect to the attachment of the disposer assembly 30 to the sink flange assembly 102, it should be understood that the lower mounting flange 118 is placed around the housing 18 that forms the inlet of the food conveying section 12. The mounting gasket 116 is then placed around that inlet as well, above the lower mounting flange 118, in a manner tending to secure the mounting gasket 116 to the inlet, by virtue of a lip at the inlet of the housing 18. Attachment of the disposer assembly 30 including the food waste disposer 10 to the sink flange assembly 102 and thereby to the sink is then particularly achieved by engaging mounting tabs 120 of the lower mounting flange 118 with ramps (or inclined mounting fasteners or edges or ridges) 122 of the upper mounting flange 110 and then rotating the lower mounting flange 118 relative to the upper mounting flange 110 until secure. When the lower mounting flange 118 and upper mounting flange 110 are secured together, the mounting gasket 116 is compressed therebetween, and provides a seal between the sink flange and inlet.

Although food waste disposers have long been successfully installed in relation to sinks in the manner described above (or in similar manners), mounting assemblies such as the mounting assembly 100 are not ideal for all applications because the mounting assemblies establish fixed connections between the food waste disposers and the sinks to which those food waste disposers are attached and consequently can communicate significant amounts of potentially-annoying vibration to the sinks from the food waste disposers when those disposers are operating. In view of this concern, alternate mounting assemblies have been developed that can at least partly isolate, in terms of the communication of vibration, food waste disposers from the sinks in relation to which those disposers are installed. U.S. Pat. No. 5,924,635, which is beneficially assigned to Taisei Corporation and entitled "Vibration Isolation Installation Mechanism For a Disposer", which is hereby incorporated by reference herein, describes several such embodiments of vibration isolating installation mechanisms by which disposers can be coupled to sinks.

More particularly, in several such conventional mechanisms, a flexible cylinder is employed to link upper and lower cylindrical components of the mechanism/assemblies and additionally, radially outwardly from the flexible cylinder, support rods are provided that also link the upper and lower cylindrical components. Support of the lower cylindrical component relative to the upper cylindrical component is provided by way of the support rods, which are coupled to those cylindrical components by way of elastic bushings or springs in manner that reduces the amount of vibration that can be communicated between the lower and upper cylindrical components. Correspondingly, this reduces the amount of vibration that can be communicated between a disposer supported via the lower cylindrical component and a sink to which the upper cylindrical component is connected. Although support rods are employed in some of these conventional embodiments, in at least one other conventional embodiment the support rods are omitted and the lower and upper cylindrical components are coupled with one another solely by way of the flexible cylinder.

Notwithstanding the availability of such conventional vibration isolating installation mechanisms or mounting assemblies, such conventional mechanisms/assemblies can be disadvantageous in several respects. In particular, conventional mechanisms/assemblies that employ support rods externally of the flexible cylinder can be expensive to manufacture and complicated to install, due to the multiple parts associated with the support rods, elastic bushings or springs, and/or other associated componentry. The conventional mechanisms/assemblies involving the support rods also can entail undesirably-high axial space requirements in terms of the distances between the disposers and sinks, and may not be aesthetically pleasing. Alternatively, the conventional mechanism/assembly employing the flexible cylinder without the external support rods envisions that the flexible cylinder will provide all support of the lower cylindrical component and attached disposer relative to the upper cylindrical component (and sink to which it is attached). Should the flexible cylinder rupture over time (indeed, perhaps partly due to the vibrations experience by the cylinder due to ongoing disposer operation), the disposer could detach from the sink.

Accordingly, it would be desirable if an improved food waste disposer assembly (or other waste disposer assembly), and/or an improved mounting assembly of or for such a food waste disposer assembly (or other waste disposer assembly), and/or an improved method of installing or mounting such a waste disposer assembly or mounting assembly in relation to another structure such as a sink, could be developed that alleviated or addressed one or more of the above-discussed concerns associated with conventional waste disposer assemblies, or alleviated or addressed one or more other concerns or disadvantages, or provided one or more advantages by comparison with conventional arrangements.

BRIEF SUMMARY

In at least some example embodiments, the present disclosure relates to a mounting system for mounting a waste disposer. The mounting system includes a tubular structure extending between first and second ends, and an enclosure structure having an additional end, where the enclosure structure is configured to be able to support, at least indirectly, the waste disposer. Further, the mounting system also includes an elastomeric member extending between the second end and the additional end, where the elastomeric member is coupled to each of the tubular structure and the enclosure structure, and serves to couple the tubular structure and the enclosure structure. Additionally, the mounting system includes a plurality of backup linkage members, where each of the plurality of backup linkage members is coupled at least indirectly to each of the tubular structure and the enclosure structure, and couples at least indirectly the tubular structure and the enclosure structure, and where each of the plurality of backup linkage members is integrally formed or molded with at least one of the tubular structure and the enclosure structure.

Additionally, in at least some example embodiments, the present disclosure relates to a waste disposer assembly that includes a waste disposer and a mounting assembly. The mounting assembly includes a first structure having a first end and a second end, and configured to be coupled at or proximate the first end to a support structure. The mounting assembly also includes a second structure having an additional end, where the waste disposer is at least indirectly attached to and supported by the second structure, and an anti-vibration linking structure extending between and coupling the second end and the additional end. Further, the mounting assembly includes a plurality of supplemental linking structures coupling the first structure and the second structure, where each of the supplemental linking structures is integrally formed or molded with respect to each of the first structure and the second structure. Additionally, the anti-vibration linking structure is overmolded around, so as to substantially encapsulate, each of the supplemental linking structures.

Further, in at least some example embodiments, the present disclosure relates to a method of assembling a mounting system for use in coupling a food waste disposer to a sink. The method includes forming a mounting subassembly including a tubular structure, an enclosure structure, and a plurality of first linking structures, where all of the tubular structure, the enclosure structure, and first linking structures are formed integrally. Also, the method includes applying an elastomeric material to the mounting subassembly, so as to provide an elastomeric formation extending between the tubular structure and the enclosure structure, and so as to couple the enclosure structure with the tubular structure. Further, the elastomeric formation serves as a primary linking structure by which the enclosure structure is supported in relation to the tubular structure, and the first linking structures are backup linking structures, and also the elastomeric formation is configured to prevent or reduce a communication of vibrations between the tubular structure and the enclosure structure.

BRIEF DESCRIPTION OF THE DRAWINGS

Embodiments of food waste disposer assemblies (or other waste disposer assemblies), mounting assemblies of or for such waste disposer assemblies, and related methods are disclosed with reference to the accompanying drawings and are for illustrative purposes only. The waste disposer/mounting assembly apparatuses and methods encompassed herein are not limited in their applications to the details of construction, arrangements of components, or other aspects or features illustrated in the drawings, but rather such apparatuses and methods encompassed herein include other embodiments or are capable of being practiced or carried out in other various ways. Like reference numerals are used to indicate like components. In the drawings:

FIG. 5 is also shown, in cross-section, to be present in relation to those cutaway portions;

DETAILED DESCRIPTION

Figure 2:
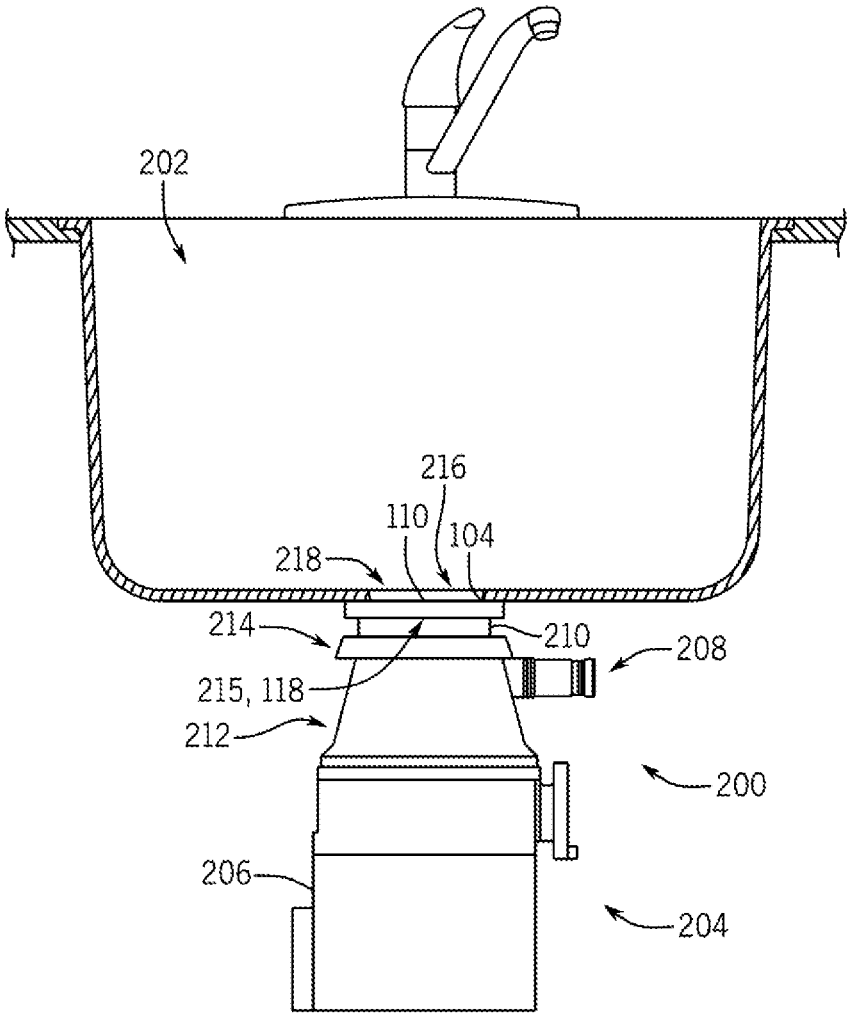
FIG. 2 is a partly cross-sectional, partly front elevation view of an example improved food waste disposer assembly having an improved mounting assembly mounted in relation to a sink, in accordance with an example embodiment encompassed herein.

Referring to FIG. 2, an improved food waste disposer assembly 200 in accordance with an example embodiment encompassed herein is installed or mounted in relation to a sink 202. Although FIG. 2 shows a side elevation view of the food waste disposer assembly 200, FIG. 2 provides a cutaway cross-sectional view of the sink 202, so as to better illustrate how the food waste disposer assembly is installed relative to the sink. The food waste disposer assembly 200 particularly includes a disposer assembly 204 that includes a food waste disposer 206 and an improved mounting assembly 208 that allows for the disposer assembly 204 to be attached to the sink 202, so as to be positioned beneath the sink.

In the present embodiment, the improved mounting assembly 208 particularly includes an anti-vibration (AV) tube 210, an enclosure 212, and an overmolded section 214 positioned between and coupling the AV tube with the enclosure. Also, the improved mounting assembly 208 includes coupling components 215, which in the present embodiment include the mounting (or sealing) gasket 116 and lower mounting flange 118 described above with reference to FIG. 1 (or components substantially similar to those components). As described further below, the AV tube 210 (which can also be referred to as a top enclosure piece or neck) can be mounted or coupled by way of the coupling components 215 to a sink flange assembly 216 of the sink 202. In the present embodiment, the sink flange assembly 216 is identical or substantially identical to the sink flange assembly 102 described above with reference to FIG. 1, and particularly includes the sink flange (or strainer flange) 104, which defines a bottom drain orifice 218 of the sink 202, as well as the upper mounting flange 110.

The enclosure 212, which can also be referred to as a bottom enclosure piece (or grind enclosure or container body), is positioned beneath the AV tube 210 and coupled therewith by way of the overmolded section 214. The enclosure 212 particularly serves to support the disposer assembly 204 including the food waste disposer 206, which is positioned beneath and coupled to that enclosure. Although for purposes of the present disclosure, the sink flange assembly 216 is considered to be a part of the sink 202, alternatively the sink flange assembly (or portions thereof, such as the upper mounting flange 110) can be considered part of the improved mounting assembly 208 (in some such cases, the improved mounting assembly can also be considered an improved sink flange assembly). Likewise, although for purposes of the present disclosure the coupling components 215 are considered to be part of the improved mounting assembly 208, alternatively the coupling components (or portions thereof, such as the lower mounting flange 118) can be considered part of the sink flange assembly.

Figure 1:
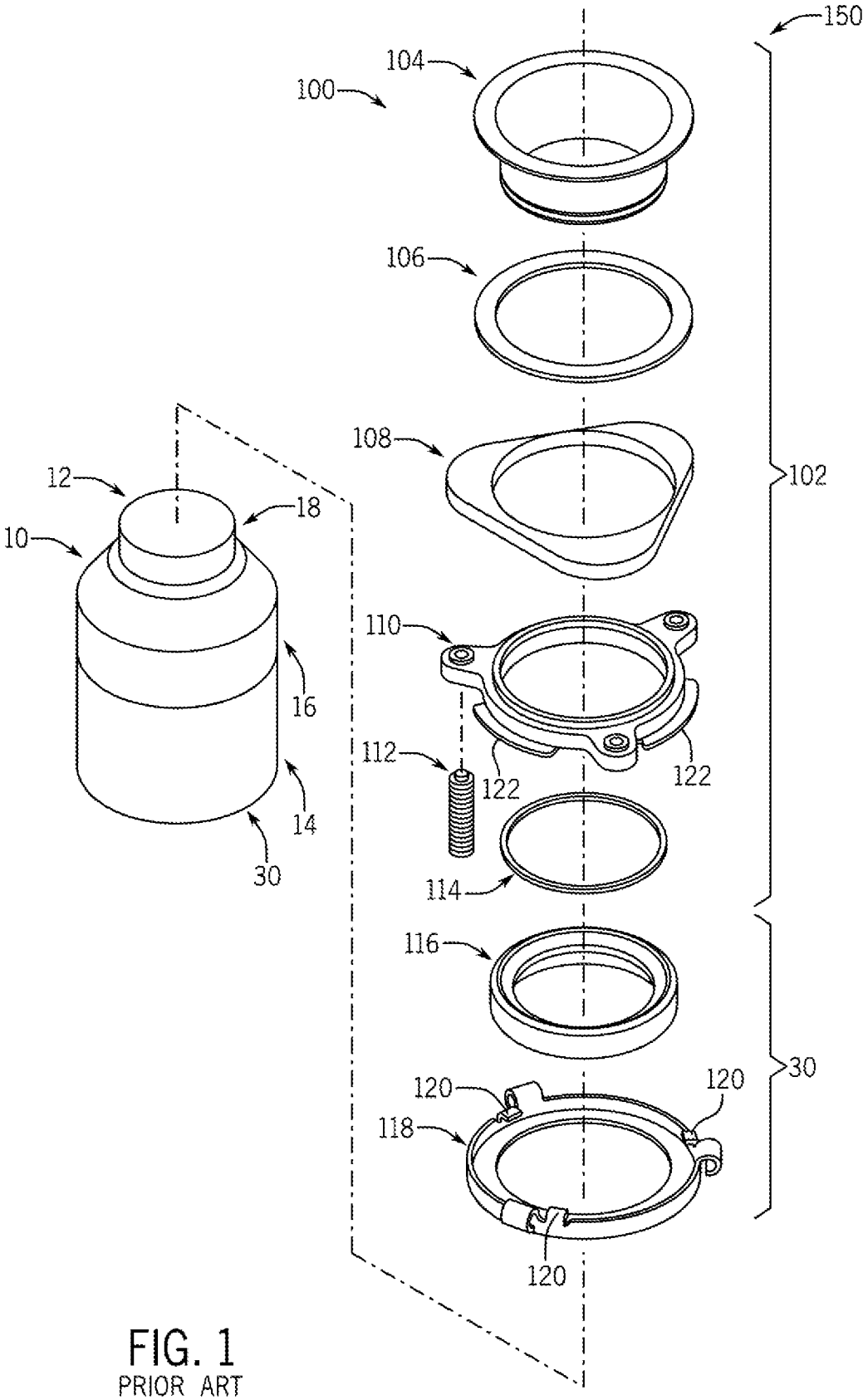
FIG. 1 PRIOR ART
FIG. 1 is an exploded view of a Prior Art food waste disposer assembly including both a mounting assembly and a disposer assembly including a food waste disposer, as can be installed in relation to another structure such as a sink.

Although the food waste disposer 206 of FIG. 2 can be the same or substantially similar to the food waste disposer 10 of FIG. 1, in alternate embodiments other types of food waste disposers can be employed. Indeed, the present disclosure is intended to encompass a wide variety of embodiments including embodiments having other types of waste disposers (including waste disposers that are suited for disposing of other materials rather than food) as well as waste disposers that are to be mounted in relation to other types of structures instead of sinks. Further, although it is envisioned in the present embodiment that the enclosure 212 is a structure that is distinct from (even though coupled to) the food waste disposer 206, it should be appreciated that in other embodiments the enclosure 212 can form a housing (e.g., a cylindrical housing) within which the food waste disposer 206 is situated and supported.

Figure 3:
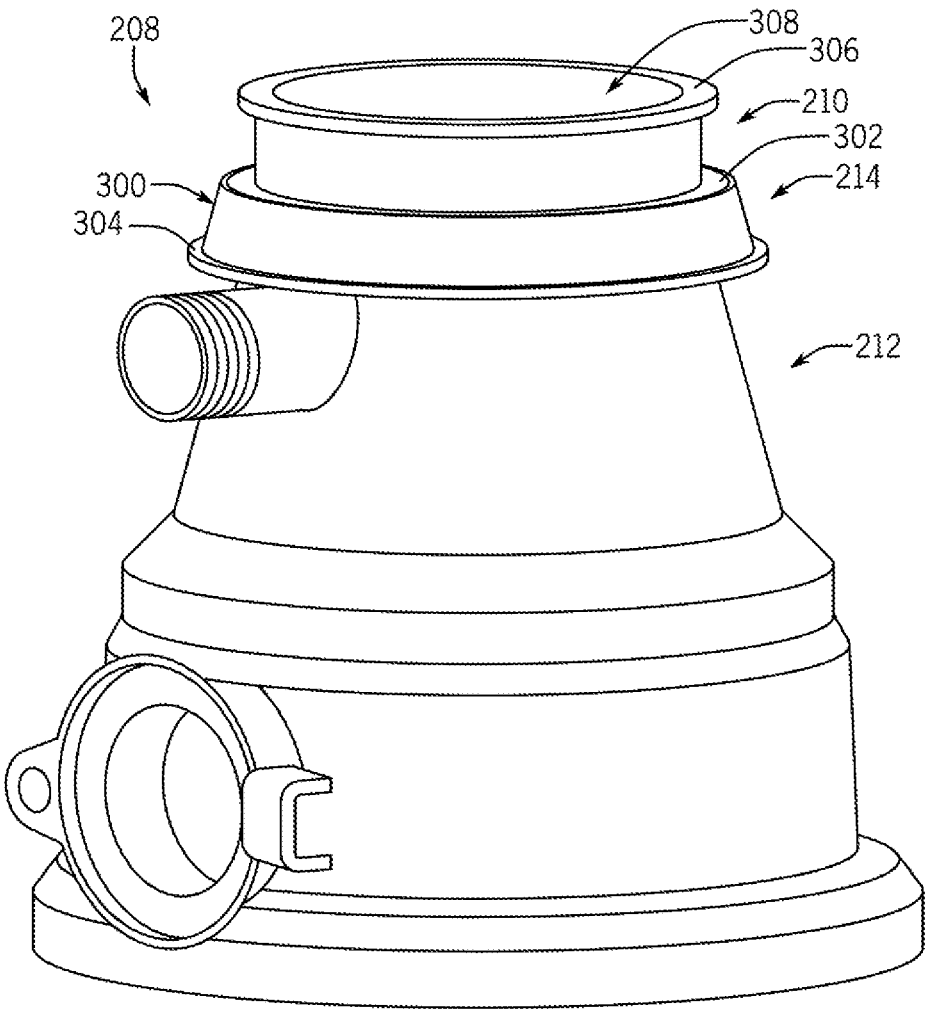
FIG. 3 is a front elevation view of portions of a first embodiment of the food waste disposer assembly represented by FIG. 2 including portions of a first embodiment of the improved mounting assembly, which includes a plurality of springs integrally formed with an anti-vibration (AV) tube and enclosure, and in which the springs are overmolded with an elastomeric material that forms an additional annular structure.

Turning to FIG. 3, a perspective view shows the improved mounting assembly 208 of FIG. 2 apart from the sink 202 and the food waste disposer 206, so as to highlight several features of that mounting assembly in particular. In this view, the overmolded section 214 is again visible, and is particularly shown to include an annular elastomeric formation 300 extending between a bottom circumferential lip 302 of the AV tube 210 and a top circumferential lip 304 of the enclosure 212. The annular elastomeric formation 300 can be made, for example, from a thermoplastic elastomer (TPE) or other elastomeric material. By virtue of employing such a material, the annular elastomeric formation 300 is configured to serve an anti-vibration or vibration-attenuation purpose—particularly in terms of eliminating or reducing the amount of vibration that can be communicated from the enclosure 212 to the AV tube 210, and thus in terms of eliminating or reducing the amount of vibration that can be communicated from the food waste disposer 206 of the disposer assembly 204 to the sink 202 when the disposer assembly 204 is coupled to the enclosure 212 and the AV tube 210 is coupled to the sink.

Additionally as shown in FIG. 3, the AV tube 210 also includes an additional top circumferential lip (or rim) 306, and extends upward from the bottom circumferential lip 302 to the top circumferential lip 306. The top circumferential lip 306 particularly extends around and defines a top orifice 308 of the AV tube 210. It should be appreciated that, when the improved food waste disposer assembly 208 is coupled to the sink 202, the top orifice 308 is aligned with the bottom drain orifice 218 of the sink flange assembly 216 (as particularly established by a bottom circumferential edge of the sink flange 104). Given such an arrangement, food waste entering the bottom drain orifice 218 of the sink 202 (as shown in FIG. 2) will proceed into the food waste disposer assembly 200 via the top orifice 308 of the AV tube 210 of the improved mounting assembly 208.

Further, the top circumferential lip 306 enables the coupling components 215 to couple the AV tube 210 to the sink flange assembly 216. More particularly, during installation of the improved food waste disposer assembly 200 in relation to the sink 202, the lower mounting flange 118 of the coupling components 215 is positioned so as to extend around the AV tube 210, between the top circumferential lip 306 and bottom circumferential lip 302. Additionally, the mounting gasket 116 is positioned around the top circumferential lip 306. More particularly, the mounting gasket 116 has an internal groove (e.g., a groove along its inner circumference) that captures the top circumferential lip 306. Before installation is complete, the lower mounting flange 118 can rest upon the top surface of the bottom circumferential lip 302. However, to achieve installation, the lower mounting flange 118 of the coupling components 215 is coupled to the upper mounting flange 110 of the sink flange assembly 216, with both the top circumferential lip 306 of the AV tube 210 as well as the mounting gasket 116 being positioned between those two flanges.

Given such an arrangement, a portion (e.g., an annular portion) of the mounting gasket 116 extends below the top circumferential lip 306, and the lower mounting flange 118 particularly contacts this portion of the mounting gasket (e.g., abuts the lower surface or underside of the mounting gasket, which in turn is in contact with the top circumferential lip along its internal groove), such that the top circumferential lip 306 is supported upon the lower mounting flange 118 indirectly by way of the mounting gasket 116 therebetween (that is, the lower mounting flange 118 does not directly contact the top circumferential lip 306 but still nevertheless that lip is supported indirectly by that flange via the mounting gasket). Additionally, given this arrangement, the lower mounting flange 118 compresses the mounting gasket 116 around and in relation to the top circumferential lip 306, so as to create a seal and prevent leakage. Accordingly, the entire AV tube 210—and all of the remaining portions of the improved mounting assembly 208 and improved food waste disposer assembly 200 supported by the AV tube—are supported in relation to the sink 202.

Figure 4:
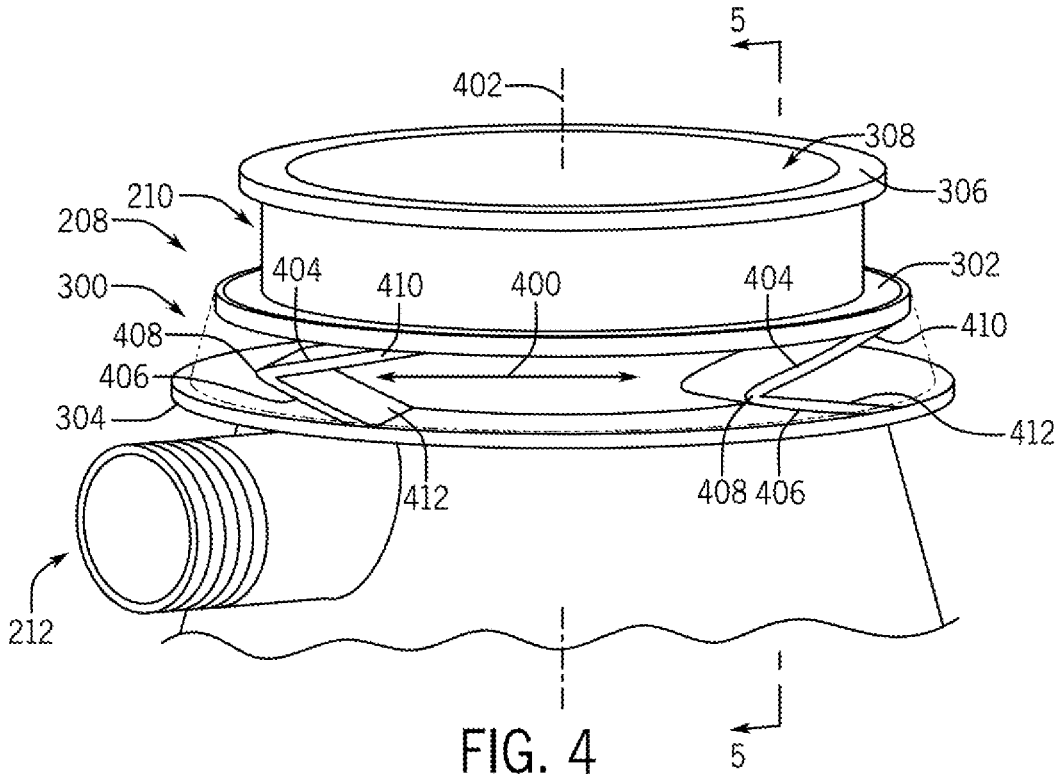
FIG. 4 is an additional front elevation view of the cutaway portions (or portions thereof) of the first embodiment of the food waste disposer assembly (including portions of the first embodiment of the improved mounting assembly) of FIG. 3, where the integrally formed springs are revealed by way of a phantom view.
Figure 5:
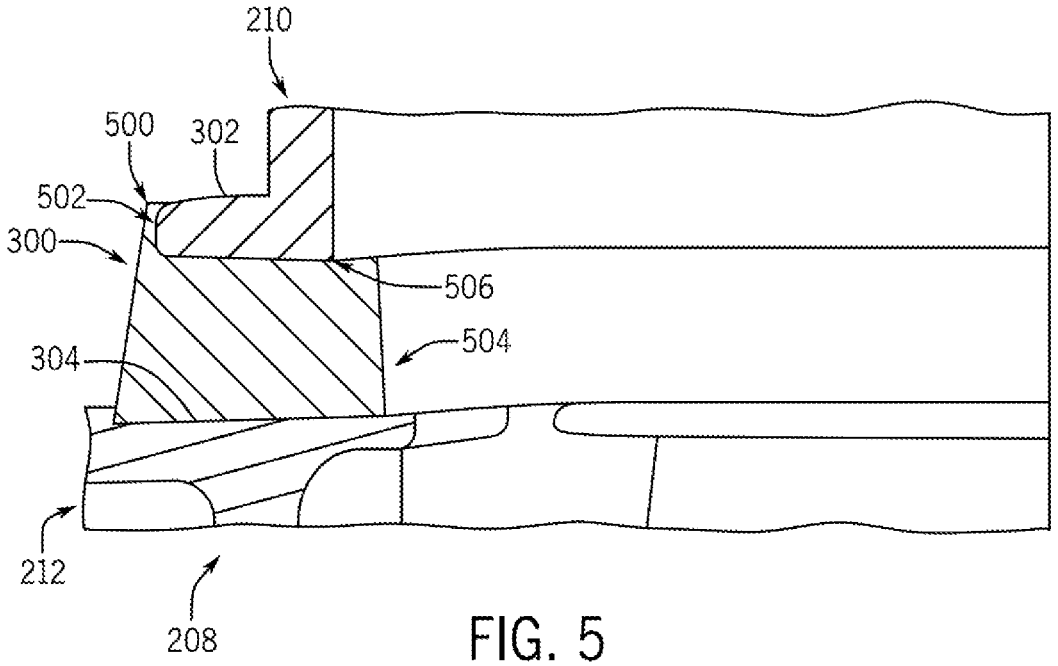
FIG. 5 is a cross-sectional view of the cutaway portions (or portions thereof) shown in FIG. 4, taken along a line 5-5 in FIG. 4.

Referring additionally to FIG. 4, FIG. 5, FIG. 6, and FIG. 7, further views are provided of portions of the improved mounting assembly 208 that are intended to reveal additional features of the overmolded section 214. FIG. 4 particularly provides a cutaway perspective view of portions of the improved mounting assembly 208, with bottom portions of the improved mounting assembly particularly being cutaway and the remaining illustrated portions being enlarged. The orientation of the improved mounting assembly 208, in term of the perspective view shown, is the same as that of FIG. 3. FIG. 5 provides an additional cross-sectional view of cutaway portions of the improved mounting assembly 208, which can be understood for example as corresponding to a section taken along line 5-5 of FIG. 4, except insofar as additional portions of the AV tube 210 and enclosure 212 are additionally cutaway by comparison with what is shown in FIG. 4.

More particularly with respect to FIG. 4, it should be recognized that, in addition to showing the annular elastomeric formation 300 extending between the AV tube 210 and the enclosure 212, FIG. 4 shows that the overmolded section 214 further includes multiple spring formations (or simply springs) 400. As illustrated, the springs 400 extend between the AV tube 210 and the enclosure 212, and in at least some embodiments can be accordion-shaped structures. Further, in the present embodiment, all of the springs 400 are integrally formed with the AV tube 210 and the enclosure 212. That is, the AV tube 210, enclosure 212, and the springs 400 all are molded from a single piece of plastic material, which can (for example) be a polymer plastic material, and which is distinct from the material forming the annular elastomeric formation 300. The springs 400, AV tube 210, and enclosure 212 can be considered to form a single integral mounting subassembly 600 (see FIG. 6), and also can generally be considered a substrate of the improved mounting assembly 208.

Also, in the present embodiment, each of the springs 400 includes a respective first ramp portion 404 and a respective second ramp portion 406 that are integrally connected at a respective junction 408 (which can be implemented without sharp points or be rounded to some extent, to facilitate manufacture and/or extend operational life). More particularly, the respective first ramp portion 404 of each of the respective springs 400 springs extends from a respective circumferential location 410 along the bottom circumferential lip 302 of the AV tube 210 toward the enclosure 212, to the respective junction 408, and the respective second ramp portion 406 of each respective spring extends from the respective junction to a respective circumferential location 412 along the top circumferential lip 304 of the enclosure 212. Additionally as shown, the respective first ramp portion 404 of each of the springs 400 is generally inclined in a first circumferential direction (e.g., clockwise, as one proceeds away from the AV tube 210 toward the enclosure 212) and the respective second ramp portion 406 of each of the springs is generally inclined in a second circumferential direction (e.g., counterclockwise, as one proceeds away from the AV tube toward the enclosure).

Additionally, it should be recognized from FIG. 4 that the springs 400 (which are intended to be shown relative to the annular elastomeric formation 300 in a ghosted or phantom manner) are surrounded by and encapsulated (or substantially encapsulated) within the annular elastomeric formation 300. That is, the annular elastomeric formation 300 is formed in relation to the AV tube 210, the enclosure 212, and the springs 400 so as to extend between and fill in the gaps between the AV tube 210, the enclosure 212, and the springs 400. In particular, none of the springs 400 is positioned radially outwardly, relative to the center line or axis 402 of the improved mounting assembly 208, so as to extend radially outwardly beyond the annular elastomeric formation 300. Rather, the annular elastomeric formation 300 by itself forms the outer circumference of the overmolded section 214, including the springs 400 thereof.

To achieve such an arrangement, the annular elastomeric formation 300 is formed by injecting and overmolding the TPE or other elastomeric material (or other material) used to form that annular elastomeric formation in relation to the integrally-formed assembly of the AV tube 210, enclosure 212, and springs 400. In particular, as illustrated by FIG. 5, which does not show any of the springs 400, the annular elastomeric formation 300 (upon being fully formed) in the present embodiment extends radially inwardly from an outer circumferential edge 500 that is slightly radially-outward of an outer circumference 502 of the bottom circumferential lip 302 of the AV tube 210 (but that is still positioned radially-inwardly relative to the outer circumference of the top circumferential lip 304) to an inner circumferential edge 504 that is slightly radially-inward of an inner circumference 506 of that bottom circumferential lip 302. In this manner, the annular elastomeric formation 300 extends beyond or overhangs the bottom circumferential lip 302, both along the outer circumference 502 and inner circumference 506, and thus extends radially outwardly and radially inwardly to farther extents than do any of the springs 400. It can be further noted that in the present embodiment the outer circumferential edge 500 tapers slightly radially-outward (e.g., takes a frustoconical shape) as one proceeds from the bottom circumferential lip 302 to the top circumferential lip 304, although in other embodiments the edge can be non-tapering, tapered in a different manner, or have some other curvature.

Figure 6:
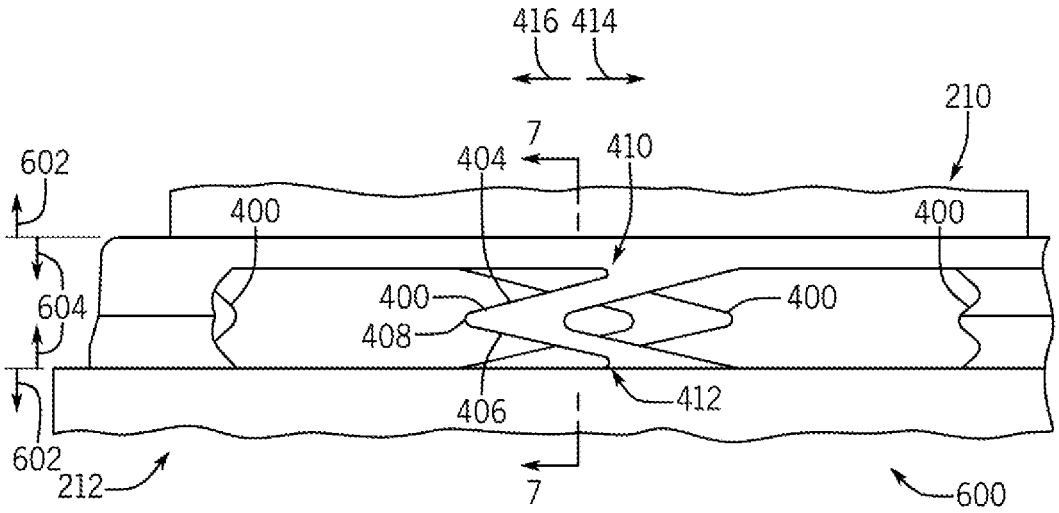
FIG. 6 is a front elevation view of further cutaway portions of the integrally-formed springs, AV tube and enclosure of the first embodiment of the food waste disposer assembly of FIG. 3, prior to an overmolding step (and thus with the additional annular structure of FIG. 3, FIG. 4, and FIG. 5 not being present)
Figure 7:
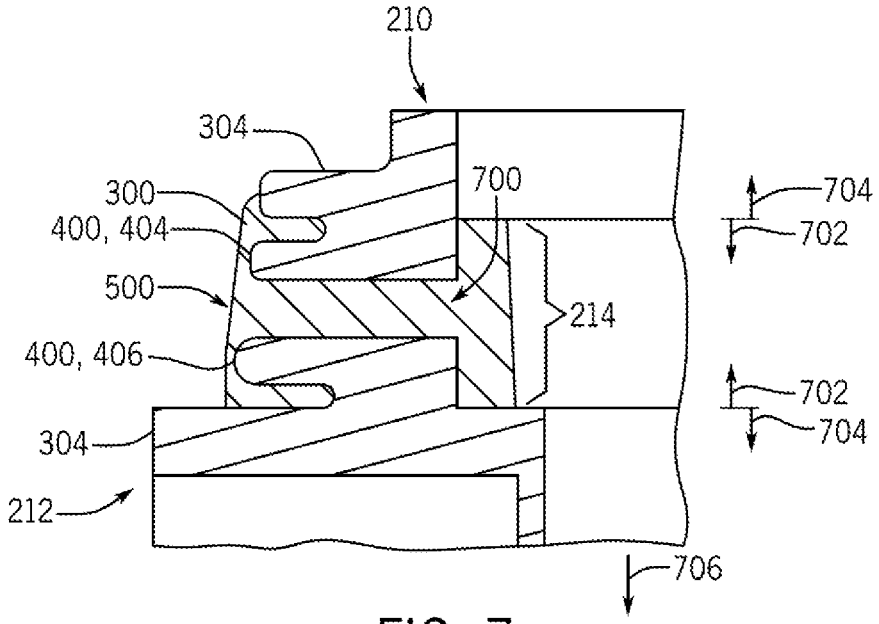
FIG. 7 is a cross-section of the further cutaway portions of FIG. 4 taken along line 7-7 of FIG. 6, at a time after an overmolding step has occurred such that additional annular structure of FIG. 3, FIG. 4.

Turning to FIG. 6 and FIG. 7, additional views are provided of portions of the improved mounting assembly 208 that are intended to highlight certain features of the improved mounting assembly 208 and also intended to inform a process of assembling the improved mounting assembly discussed in relation to FIG. 8 below. In particular, FIG. 6 provides an additional cutaway view of portions of the improved mounting assembly 208, in which all four of the springs 400 (along with portions of the AV tube 210 and the enclosure 212) are visible, but in which the annular elastomeric formation 300 is absent. The view provided in FIG. 6 can be considered a side (e.g., right side) elevation view of portions of the mounting subassembly 600, including the combination of the springs 400, the AV tube 210, and the enclosure 212, where portions of the AV tube 210, the enclosure 212, and one of the springs are cutaway.

Additionally, referring to FIG. 7, a further cross-sectional view of cutaway portions of the improved mounting assembly 208 is provided. The cross-sectional view of FIG. 7 can be understood for example as corresponding to a section taken along line 7-7 of FIG. 6, except insofar as portions of the annular elastomeric formation 300 are now present and insofar as additional portions of the AV tube 210 and enclosure 212 are cutaway by comparison with what is shown in FIG. 6. Among other things, it can be appreciated from FIG. 7 that the annular elastomeric formation 300 extends between the respective first and second ramp portions 404, 406 of each respective spring at locations such as a location 700 at which those ramp portions are apart from one another (e.g., other than at the respective junction 408 linking those ramp portions).

Notwithstanding the configuration of the springs 400 described above, it should be appreciated that, in other embodiments, the springs can take other forms. For example, the inclination of the ramp portions can vary from that described above (e.g., different ones of the springs can have ramp portions that are inclined in different manners), and/or one or more of the springs can include more than two ramp portions or include other (e.g., non-ramped, or vertical) portions. Also, even though each of the ramp portions 404, 406 in the present example embodiment are generally straight structures, in other embodiments one or more of the ramp portions can be curved. Additionally, although in the present embodiment it is envisioned that there are four of the springs 400, which are circumferentially spaced equidistantly from one another around a center line of the 402 of the improved mounting assembly (and of the AV tube 210 and enclosure 212 thereof), in alternate embodiments the number or relative spacing of the springs 400 can vary from that shown. For example, in some alternate embodiments, there can be two, three, six, or eight springs, and/or certain neighboring ones of the springs can be positioned more closely to one another than other neighboring ones of the springs. Indeed, in general, the geometries and number of springs can be set or iterated to optimize the anti-vibration performance of the spring-overmold mount.

In the present example embodiment, the springs 400 fulfill multiple roles. First, although it is intended that the annular elastomeric formation 300 serve as the primary support structure linking the AV tube 210 and the enclosure 212, the springs 400 can serve a backup support structure. That is, although it is intended that the annular elastomeric formation will serve as the primary weight bearing structure allowing for any weight coupled to the enclosure (e.g., the disposer assembly 204 with the food waste disposer 206) to be borne by the AV tube (and any structure supporting the improved food waste disposer assembly 200 such as the sink 202), the springs 400 can also provide such support. This can be beneficial, for example, if over time the annular elastomeric formation 300 experiences creeping or becomes distended, or if for some reason the annular elastomeric formation itself ceases to fully or substantially couple the AV tube 210 with the enclosure 212 (for example, if adhesive used to link the annular elastomeric formation 300 with the AV tube or enclosure weakens). In short, the springs 400 provide a redundant coupling mechanism by which the AV tube 210 and enclosure 212 are linked, so as to supplement the coupling provided by the annular elastomeric formation 300.

Second, in the present embodiment, the springs 400 also provide a mechanism by which a pre-load (in tension or compression) can be implemented as an aspect of the improved mounting assembly 208. As described further below in regard to FIG. 8, such a pre-load can be applied at the time of the overmolding process. This can permit the TPE or other elastomeric material (or other material serving as an overmold material) employed to form the annular elastomeric formation 300 to be influenced with regard to its loading during post-installation service. Such manner of implementation can serve to offset weight associated with a unit or structure that is borne by the enclosure 212 (e.g., the food waste disposer 206), and/or has the potential to achieve an optimal state for performance and structural integrity. In some circumstances, it is envisioned that the springs 400 and annular elastomeric formation 300 can promote a spring/dashpot dampening effect.

Figure 8:
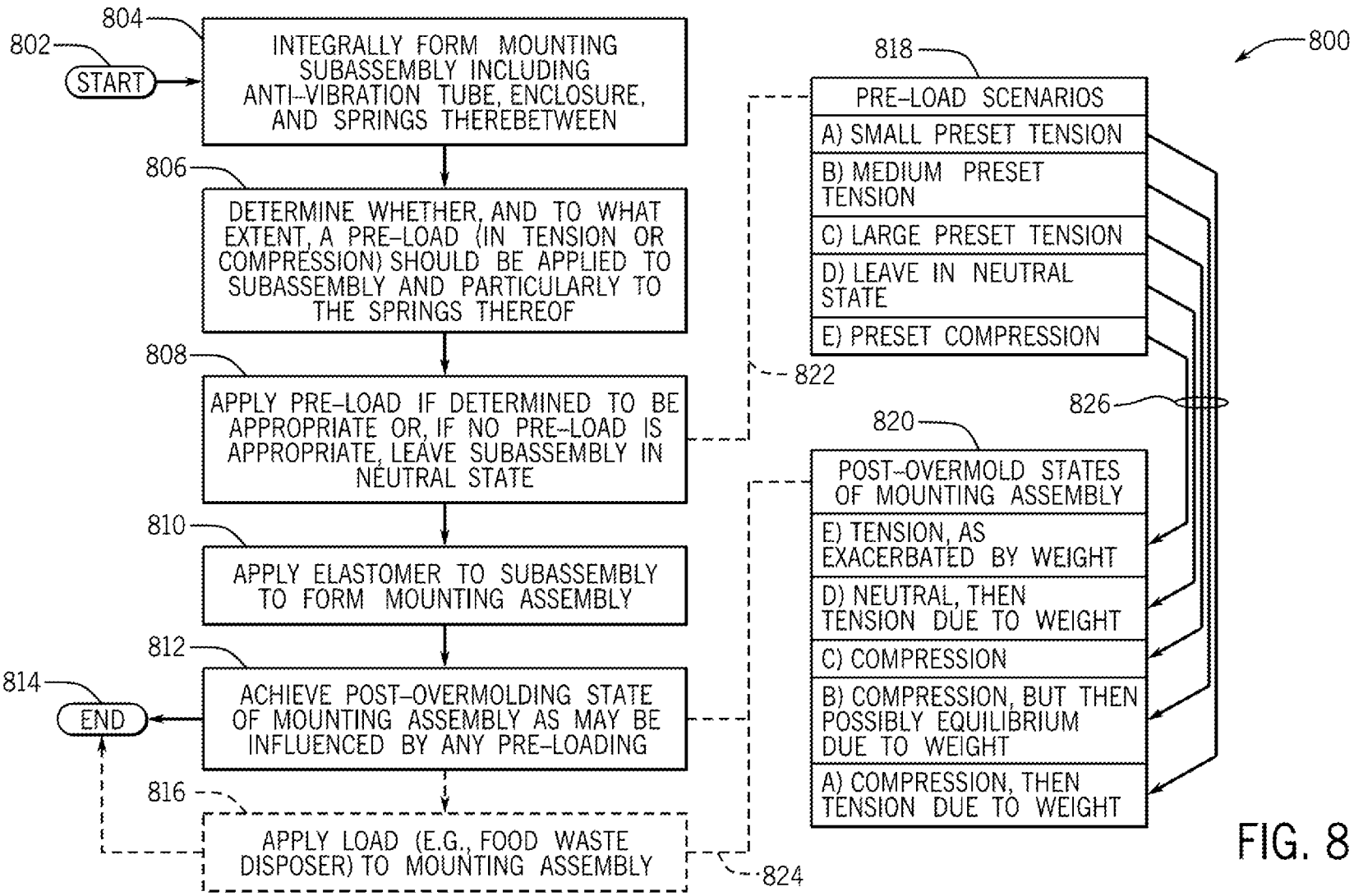
FIG. 8 is a flow chart illustrating example steps of assembly of the first embodiment of the improved mounting assembly of the food waste disposer assembly shown in FIG. 3, FIG. 4, FIG. 5, FIG. 6, and FIG. 7.

Referring now to FIG. 8, a flow chart 800 is provided to illustrate an example process or method of manufacturing or assembly of the improved mounting assembly 208. As will be described in further detail below, the improved mounting assembly 208 can be formed in a variety of manners that may or may not include pre-loading, so that the improved mounting assembly in its completed form may or may not provide an offset relative to loading that may occur subsequently. As shown in the flow chart 800, upon the assembly process commencing at a start step 802, then at a first step 804 the mounting subassembly 600 including the AV tube 210, the enclosure 212, and the springs 400 extending therebetween is integrally formed (e.g., molded out of polymer plastic). The formation of the mounting subassembly 600 (or substrate) can in some embodiments be performed through the use of multiple slides in the molding tool. For example, with reference to FIG. 6, two slides could be employed to form a portion of the mounting subassembly 600 including the spring 400 through which the line 7-7 extends, where the two slides upon forming that spring would be removed apart from one another in opposite directions perpendicular to the line 7-7 as represented by first and second arrows 414 and 416.

Next, at a second step 806, it is determined whether, and to what extent, a pre-load (in tension or compression) should be applied to the mounting subassembly 600, and particularly to the springs 400 thereof. This determination for example can be made during manufacturing, and in some cases can be made automatically (e.g., by a computer). In at least some circumstances or embodiments, this determination takes into account the expected loading that will be experienced by the improved mounting assembly 208 (e.g., due to the weight of the food waste disposer 206).

Subsequently, at a third step 808, if it is determined at the second step 806 that a pre-load should be applied, then that pre-load is applied to the mounting subassembly 600 (and particularly to the springs 400 thereof) or, alternatively, if it is determined at the second step 806 that no pre-load should be applied, then the mounting subassembly 600 is left in a neutral (e.g., unloaded) state. A preload involving a preset tension can be applied at the step 808, for example, by applying a tension force between the AV tube 210 and the enclosure 212 as represented by first arrows 602 in FIG. 6, and a preload involving a preset compression can be applied at the step 808, for example, by applying a compression upon the AV tube and the enclosure relative to each other as represented by second arrows 604 in FIG. 6.

Next, at a fourth step 810, an elastomer is applied to the mounting subassembly 600 to form the combination of structures that are comprised by the improved mounting assembly 208. As already described above, this application involves overmolding the elastomer relative to the AV tube 210, the enclosure 212, and the springs 400, especially in a manner so that the elastomer fills in the gaps among these components and couples the AV tube 210 with the enclosure 212, as well as surrounds or encapsulates (or substantially encapsulates) the springs. By virtue of this step, the elastomer forms the annular elastomeric formation 300 and, in combination with the springs 400, forms the overmolded section 214. The elastomer applied at the fourth step 810 can be, as mentioned above, TPE or another elastomeric material (or other material). In at least some embodiments, the elastomer can be applied by way of injection (e.g., during a "neck fill").

Upon the completion of the fourth step 810, the process of FIG. 4 further advances to a fifth step 812, after which the process ends at an end step 814. At the fifth step 812, a post-overmolding state is achieved by the improved mounting assembly 208 due to the solidifying of the elastomer applied at the step 810. The post-overmolding state that is achieved at the fifth step 812 particularly may be influenced by any pre-loading that was applied at the third step 808. For example, if a preload involving a preset tension was applied at the step 808 (as represented by the first arrows 602), then the post-overmolding state that will be achieved at the fifth step 812 will be a state in which the annular elastomeric formation 300 experiences compression as represented by third arrows 702 shown in FIG. 7. Such compression would occur due to the springs 400 of the improved mounting assembly 208 tending to return to their unstressed (without the preset tension) state. Also for example, if a preload involving a preset compression was applied at the step 808 (as represented by the second arrows 602), then the post-overmolding state that will be achieved at the fifth step 812 will be a state in which the annular elastomeric formation 300 experiences tension as represented by fourth arrows 704 shown in FIG. 7. Such tension would occur due to the springs 400 of the improved mounting assembly 208 tending to return to their unstressed (without the preset compression) state. Additionally as will be appreciated, if no preload involving a preset compression or tension is applied at the third step 808, then the annular elastomeric formation 300 would not tend to experience tension or compression post-overmolding (at least until such time as the improved mounting assembly 2087 experiences a load such as due to the attachment of the food waste disposer 206).

Although the process represented by the flow chart 800 particularly is intended to relate to the manufacturing or assembling of the improved mounting assembly 208, this process can be understood as also encompassing or extending to encompass additionally the loading of the improved mounting assembly, as represented by a further step 816. Such loading can occur, for example, when a food waste disposer such as the food waste disposer 206 is attached to the enclosure 212 of the improved mounting assembly 208. It should be appreciated that the further step 816 is shown in dashed lines in FIG. 8 because that step would typically occur after completion of the process of manufacturing or assembling of the improved mounting assembly 208 (rather than being considered part of that process), and can be consider a step of a larger process of manufacturing or assembling the food waste disposer assembly 200 including both the disposer assembly 204 (that includes the food waste disposer 206) and the improved mounting assembly 208. As further represented by an arrow 706 shown in FIG. 7, the application of a load to the improved mounting assembly 208 will typically cause a downward tension force to be applied to the improved mounting assembly.

Referring still to FIG. 8, it should be recognized that the process 800 can be performed in multiple different manners. In particular, the process can be performed in different manners that involve different levels of pre-loading (or absence thereof) with respect to the mounting subassembly 600 and particularly the springs 400 thereof. Further, depending upon the level of pre-loading of the mounting subassembly 600/springs 400 that is applied (or not applied), different post-overmolding states of the TPE or other elastomeric material (or other material) of the overmolded section 214, and of the improved mounting assembly 208 as a whole, as well as of the entire food waste disposer assembly 200 when the disposer assembly 204 is attached to the improved mounting assembly, can be achieved.

More particularly, FIG. 8 shows a first side-box 818 that is provided to illustrate five example pre-load scenarios, in terms of the level of pre-loading that is applied or not applied with respect to the mounting subassembly 600/springs 400. A dashed line 822 is shown to link the first side-box 818 with the third step 808, as it is during the third step that pre-loading is applied to the mounting subassembly 600/springs. The first side-box 818 particularly illustrates the following pre-load scenarios: (A) a first scenario in which only a small preset tension (e.g., tension level A) is applied to mounting subassembly 600/springs 400; (B) a second scenario in which a medium preset tension (e.g., tension level B) is applied to the mounting subassembly/springs; (C) a third scenario in which a large preset tension (e.g., tension level C) is applied to the mounting subassembly/springs; (D) a fourth scenario in which no pre-load (no preset tension or preset compression) is applied to the mounting subassembly/springs; and (E) a fifth scenario in which a preset compression is applied to the mounting subassembly/springs.

It should be appreciated that any arbitrary level or magnitude of tension or compression can be applied at the third step 808. However, the five (5) pre-load scenarios that are shown in the first side-box 818 have been chosen because the scenarios can result in qualitatively different outcomes, in terms of post-overmolding states of the improved mounting assembly 208 and the overall food waste disposer assembly 200. Given these different scenarios in terms of the application (or absence of application) of pre-loading to the mounting subassembly 600/springs 400, the TPE or other elastomeric material (or other elastomer or material) of the overmolded section 214 can experience different levels of tension or compression (or absence thereof) after the overmolding has occurred at the step 810. Additionally, although the TPE or other elastomeric material (or other elastomer or material) can experience such post-overmolding tension or compression subsequent to overmolding even when no weight is applied to the improved mounting assembly 208, such tension or compression that is experienced by the TPE or other elastomeric material (or other elastomer) and by the improved mounting assembly overall can additionally change when a weight such as that due to the food waste disposer 206 is attached to improved mounting assembly 208.

More particularly in this regard, the post-overmold states of the improved mounting assembly shown in the second side-box 820 include five possible pairs of states (A, B, C, D, and E) that respectively correspond to the respective five pre-load scenarios shown in the first side-box 818 (A, B, C, D, and E discussed above), with the correspondence being in shown in FIG. 8 by connecting arrows 826. Each of the five pairs of states illustrated by the second side-box 820 encompasses two states (or sub-states), namely, a first "unweighted" post-overmolded state of the improved mounting assembly 208 that is reached at the fifth step 812, prior to the improved mounting assembly being loaded by any additional weight (such as that of the food waste disposer 206), and also a second "weighted" state of the improved mounting assembly that is reached when a load is applied to the improved mounting assembly (e.g., due to the attachment of the food waste disposer 206) at the step 816. That the states represented by the second side-box 820 are achieved at the step 812 or the step 816 is indicated by a dashed link 824 connecting the second side-box 820 with each of the fourth step 812 and the step 816 as well.

It should be appreciated that there exists correlations between the pre-load scenarios and the post-overmolding states as represented in the side-boxes 818 and 820. In general, if tension is applied to the mounting subassembly 600/springs 400 prior to overmolding, then the springs post-overmolding will tend to return to their natural, unstressed position, and consequently the TPE or other elastomeric material (or other material) applied during overmolding will tend to be compressed. Inversely, if the mounting subassembly 600/springs 400 are compressed prior to overmolding, then the springs post-overmolding will tend to return to their natural, unstressed position, and consequently the TPE or other elastomeric material (or other material) applied during overmolding will tend to experience tension. Further, the application of a load (e.g., due to the attachment of the food waste disposer 206) post-overmolding will tend to add tension or reduce compression within the improved mounting assembly 208. Therefore, the overall tension or compression experienced after a load is applied within the improved mounting assembly 208, and particularly by the springs 400, will depend upon the relative balance between any compression or tension that exists within the improved mounting assembly 208 prior to load being applied, the tension change imparted by the weight of the load itself.

The post-overmold states of the improved mounting assembly 208 shown in FIG. 8 exemplify these principles. More particularly, as shown, if the pre-load scenario experienced by the mounting subassembly 600/springs 400 involves a preset compression (scenario E), then the improved mounting assembly 208 will experience tension as its post-overmold state. The amount of tension will increase from a first level of tension occurring prior to a load being applied, due to the springs 400, to a second level of tension occurring after the load has been applied (e.g., due to the attachment of the food waste disposer 206). By contrast, if the pre-load scenario experienced by the mounting subassembly 600/springs 400 involves no pre-load (scenario D), then the improved mounting assembly 208 will not experience any tension or compression as its post-overmold state, prior to a load being applied. However, the improved mounting assembly 208 will experience tension after the load has been applied (e.g., due to the attachment of the food waste disposer 206)—that is, the springs and annular elastomeric formation (e.g., TPE) will be in tension due to unit weight upon installation.

Further, if the pre-load scenario experienced by the mounting subassembly 600/springs 400 involves a preset tension (scenario C, B, or A), then the improved mounting assembly 208 will experience compression as its post-overmold state, as achieved at the fifth step 812 prior to the application of any load. The magnitude of the compression experienced in this state will correspond directly to the level of preset tension that was applied at the third step 808. However, upon the application of a load (e.g., due to the attachment of the food waste disposer 206) at the step 816, the improved mounting assembly 208 (and the springs 400 thereof) can experience any of compression, tension, or neither. It will be appreciated that, if the preset tension is sufficiently small (e.g., in accordance with scenario A of the first side-box 818), even though compression may be experienced by the TPE or other elastomeric material (or other material) initially after overmolding has been completed, any such compression will be superseded by the tension arising from the application of weight to the improved mounting assembly 208. Consequently, as indicated in the second side-box 820, the post-overmold states of the improved mounting assembly 208 associated with scenario A involve compression followed by tension arising due to the weight applied to the improved mounting assembly 208.

Inversely, it will be appreciated that, if the preset tension is sufficiently large (e.g., in accordance with scenario C of the first side-box 818), compression may be experienced by the TPE or other elastomeric material (or other material) initially after overmolding has been completed, and continue to be experienced following the application of the load to the improved mounting assembly 208. In such cases, the load borne by the improved mounting assembly 208 is insufficient to overcome the internal compression experienced by the improved mounting assembly 208 due to the internal action of the springs 400.

Additionally, there also exists the possibility that the application of the pre-load at the third step 808 is set at just an appropriate amount that any internal compression experienced by the improved mounting assembly 208 due to the internal action of the springs 400 can be exactly (or substantially exactly) balanced by the tension generated by a load borne by the improved mounting assembly 208. Thus, as illustrated in FIG. 8, if a particular "medium" preset tension is applied at the third step 808 (e.g., in accordance with scenario B), then compression may be experienced by the TPE or other elastomeric material (or other material) initially after overmolding has been completed at the fifth step 812, but then the improved mounting assembly 208 can experience an equilibrium between compression and tension following the application of the load at the step 816.

Thus, the various scenarios and states shown in FIG. 8 can be summarized as follows. If no pre-loading is applied, in accordance with Scenario D, then there will not be any post-overmold compression or tension experienced by the TPE (or other elastomeric or other material) until installation of the food waste disposer occurs (e.g., when a load is applied) in accordance with the step 816. However, if pre-loading is applied in accordance with scenario A, the TPE (or other elastomeric or other material) will experience post-overmold compression due to the springs 400 and further, if the preset tension was small relative to the effect of unit weight, it would revert to tension upon installation of the food waste disposer (but less than if overmold in neutral state).

Further, if pre-loading is applied in accordance with scenario B and the preset was balanced against the effect of unit weight (e.g., the effect of the application of a load corresponding to installation of the food waste disposer), the TPE will experience post-overmold compression due to springs, and further can end up in an equilibrium state (or a state that cycles through tension and compression during operation) upon installation of the food waste disposer. Also, if pre-loading is applied in accordance with scenario C, then TPE will experience post-overmold compression due to springs and, if the preset was large relative to the effect of unit weight, the weight can be offset such that the TPE will remain in a state of compression (or mostly so, during operational cycling). Finally, if pre-loading is applied in accordance with scenario E, then TPE will experience post-overmold tension due to springs, the state of which will be exacerbated by the addition of unit weight upon installation.

Notwithstanding the above description relating to FIG. 3, FIG. 4, FIG. 5, FIG. 6, FIG. 7, and FIG. 8 pertaining to the improved mounting assembly 208 of FIG. 2, it should be appreciated that the present disclosure is intended to encompass numerous other embodiments of improved mounting assemblies as well. For example, turning to FIG. 9, a perspective view of an alternate embodiment of an improved mounting assembly 908 is provided. It should be appreciated that the improved mounting assembly 908 can be implemented in a food waste disposer assembly that is identical or substantially identical to the food waste disposer assembly 200 of FIG. 2, except insofar as the improved mounting assembly 908 is intended to take the place of the improved mounting assembly 208 described above. As in the case of FIG. 3, FIG. 9 is particularly intended to show the improved mounting assembly 908 apart from the sink 202 and the food waste disposer 206, so as to highlight several features of the improved mounting assembly.

Similar to the improved mounting assembly 208, the improved mounting assembly 908 particularly includes an anti-vibration (AV) tube 910, an enclosure 912, and an overmolded section 914 positioned between and coupling the AV tube with the enclosure. The AV tube 910 is configured to be mounted or coupled to the sink flange (or strainer flange) 216 of the sink 202 (discussed above). The enclosure 912, which is positioned beneath the AV tube 910 and coupled therewith by way of the overmolded section 914, supports the food waste disposer 206, which is positioned beneath and coupled to that enclosure.

Figure 9:
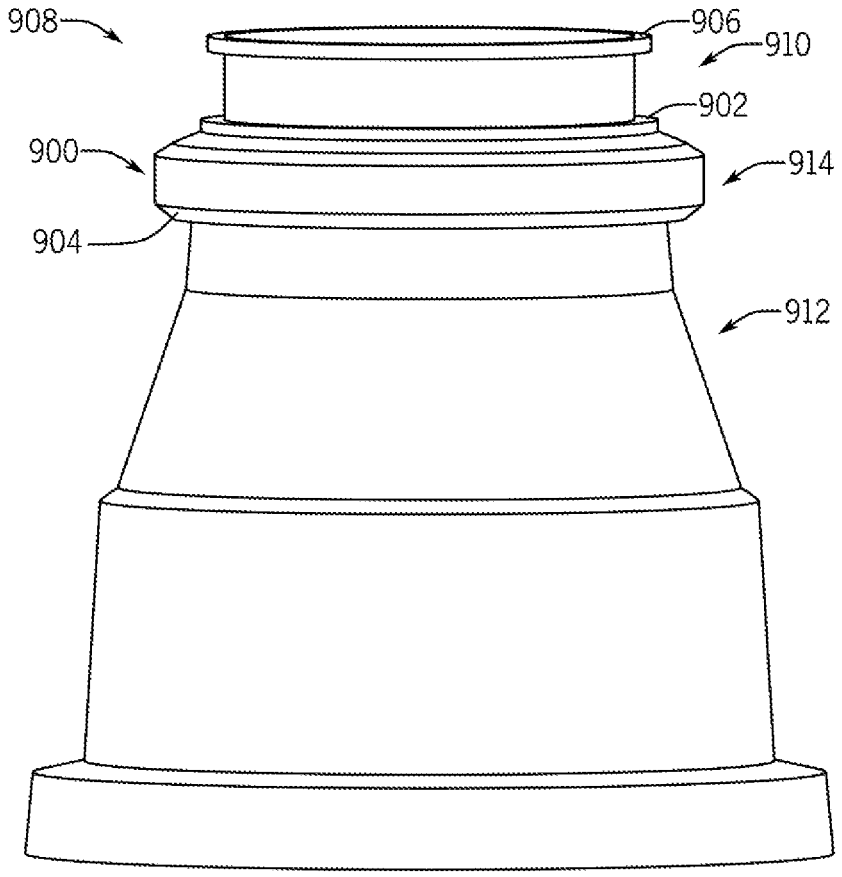
FIG. 9 is a front elevation view of portions of a second embodiment of the food waste disposer assembly represented by FIG. 2 including portions of a second improved mounting assembly, in which the improved mounting assembly includes a plurality of living hinges integrally formed with an anti-vibration (AV) tube and enclosure, and in which the living hinges are overmolded with an elastomeric material that forms an additional annular structure.

In the view provided by FIG. 9, the overmolded section 914 is visible. It should be appreciated that the overmolded section 914 takes the same (or substantially the same) position within the improved mounting assembly 908 as is taken by the overmolded section 214 within the improved mounting assembly 208, and fulfills the same (or substantially the same) role in the improved mounting assembly 908 as is fulfilled by the overmolded section 214 in the improved mounting assembly 208. Similar to the overmolded section 214, the overmolded section 914 particularly includes an annular elastomeric formation 900 extending between a bottom circumferential lip 902 of the AV tube 910 and a top circumferential lip 904 of the enclosure 912. In addition as shown, the AV tube 910 also includes an additional top circumferential lip (or rim) 906, and is shown to extend upward from the bottom circumferential lip 902 to the top circumferential lip 906. As with the top circumferential lip 306 of FIG. 3, the top circumferential lip 906 particularly extends around and defines a top orifice of the AV tube 910, by way of which food waste can proceed into the food waste disposer assembly as described above.

As with the annular elastomeric formation 300, the annular elastomeric formation 900 can be made, for example, from a thermoplastic elastomer (TPE) or other elastomeric material. Also, as with the annular elastomeric formation 300, the annular elastomeric formation 900 serves an anti-vibration purpose, particularly in terms of eliminating or reducing the amount of vibration that can be communicated from the enclosure 912 to the AV tube 910, and thus in terms of eliminating or reducing the amount of vibration that can be communicated from the food waste disposer 206 of the disposer assembly 204 to the sink 202 when the disposer assembly 204 is coupled to the enclosure 912 and the AV tube 910 is coupled to the sink. However, it will be observed from a comparison of FIG. 9 relative to FIG. 3 that the overmolded section 914, and the annular elastomeric formation 900 thereof, differ respectively in shape from the overmolded section 214 and the annular elastomeric formation 200 thereof. More particularly, the overmolded section 914 and annular elastomeric formation 900 bulge radially outwardly at locations in between the bottom and top circumferential lips 902 and 904, unlike the overmolded section and annular elastomeric formation 200, which maintain a diameter that is substantially the same as the outer diameter of the bottom circumferential lip 302.

Figure 10:
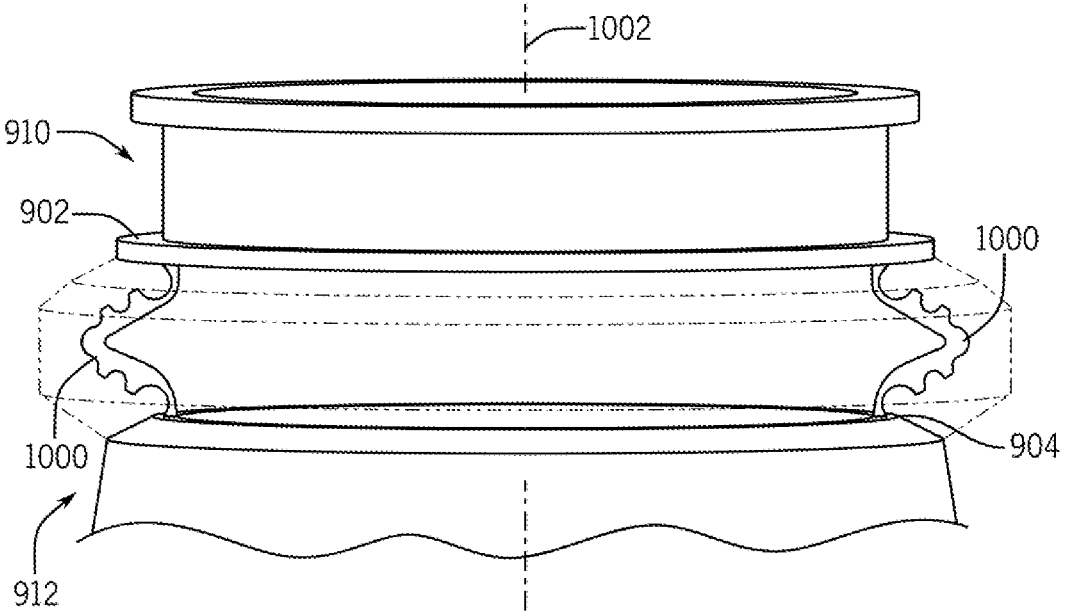
FIG. 10 is an additional front elevation view of additional cutaway portions (or portions thereof) of the second embodiment of the improved mounting assembly of the food waste disposer assembly of FIG. 9, where the integrally formed living hinges are revealed.
Figure 11:
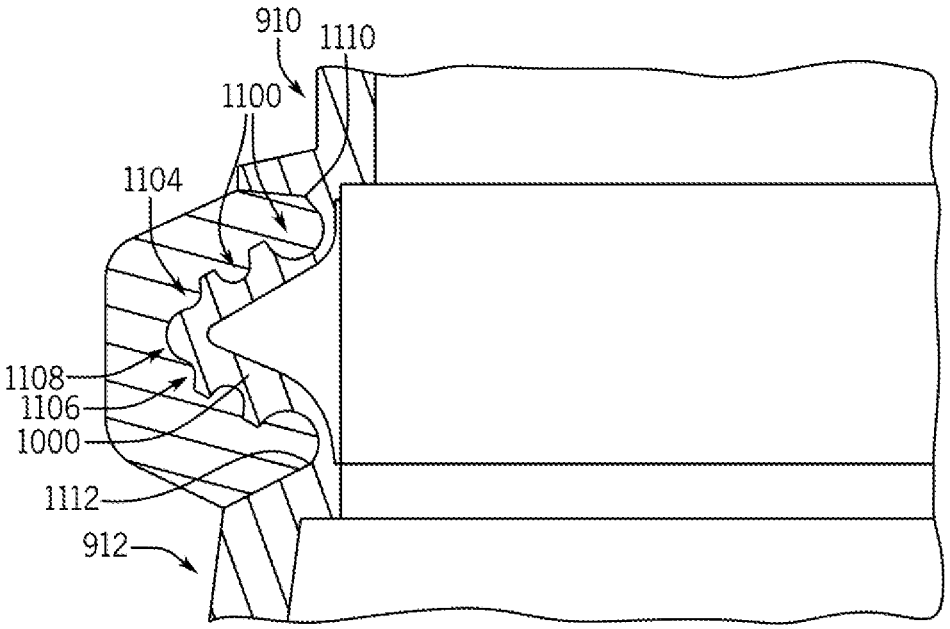
FIG. 11 is a detail view of the additional cutaway portions of FIG. 10 that more clearly reveals features of one of the living hinges.

Referring additionally to FIG. 10 and FIG. 11, further views are provided of portions of the improved mounting assembly 908 in manners intended to reveal additional features of the overmolded section 914. FIG. 10 particularly provides a cutaway perspective view of portions of the improved mounting assembly 908, with bottom portions of the improved mounting assembly particularly being cutaway and the remaining illustrated portions being enlarged. The orientation of the improved mounting assembly 908, in terms of the perspective view shown, is the same as that of FIG. 9. FIG. 11 provides an additional detail view highlighting a portion of what is shown in FIG. 10.

More particularly with respect to FIG. 10 and FIG. 11, it should be recognized that, in addition to showing the annular elastomeric formation 900 extending between the AV tube 910 and the enclosure 912, the overmolded section 914 further includes multiple living-hinge members 1000 (one of which is shown in FIG. 11). As illustrated, the living-hinge members 1000 extend between the AV tube 910 and the enclosure 912. Further, in the present embodiment, all of the living-hinge members 1000 are integrally formed with the AV tube 910 and the enclosure 912. That is, the AV tube 210, enclosure 212, and the living-hinge members 1000 all are molded from a single piece of plastic material, which can (for example) be a polymer plastic material, and which is distinct from the material forming the annular elastomeric formation 900. Accordingly, the living-hinge members 1000, AV tube 210, and enclosure 212 can be considered to form a single integral mounting subassembly.

In the present example embodiment, there are two of the living-hinge members 1000, which are at diametrically-opposed locations from one another on the improved mounting assembly 908 (and of the AV tube 910 and enclosure 912 thereof). In alternate embodiments, the number or relative spacing of the living-hinge members 1000 can vary from that shown. For example, in other alternate embodiments, there can be three, four, six, or eight living-hinge members, and/or certain neighboring ones of the living-hinge members (particularly if there are more than two such members) can be positioned more closely to one another than other neighboring ones of the living-hinge members. Also, although it is envisioned that the improved mounting assembly 908 will include only living-hinge members and that the improved mounting assembly 208 will include only springs, in further embodiments it is possible for a given improved mounting assembly to include any combination of one or more springs and one or more living-hinge members.

As is evident particularly from FIG. 11, in the present embodiment each of the living-hinge members 1000 includes a plurality of indentations 1100 at several locations along the length of the respective member, at which the living-hinge member has reduced thickness and can easily bend (e.g., due to the relative narrowness of the living-hinge member at those locations). Each of the living-hinge members 1000, when positioned so as to be compressed somewhat between the AV tube 910 and the enclosure 912, takes a form as shown in FIG. 11 in which the respective living-hinge member has a respective first ramp portion 1104 and a respective second ramp portion 1106. As shown, the respective first ramp portion 1104 of the respective living-hinge member 1000 is integrally connected to the respective second ramp portion 1106 of the respective living-hinge member at a respective bend location or junction 1108. Such bending can for example be at angle(s) of less than 180 degrees.

More particularly, the respective first ramp portion 1104 of each of the respective living-hinge members 1000 extends from a respective circumferential location 1110 along the bottom circumferential lip 902 of the AV tube 910 toward the enclosure 912, to the respective junction 1108, and the respective second ramp portion 406 of each respective spring extends from the respective junction to a respective circumferential location 1112 along the top circumferential lip 904 of the enclosure 912. Additionally as shown, the respective first ramp portion 1104 of each of the living-hinge members 1000 is generally inclined in a first radial direction (e.g., radially outward as one proceeds downward from the AV tube 910 toward the enclosure 912) and the respective second ramp portion 1006 of each of the living-hinge members 1000 is generally inclined in a second radial direction (e.g., radially outward as one proceeds upward from the enclosure 912 toward the AV tube 910).

It should be appreciated that the particular configurations of the living-hinge members 1000 as shown in FIG. 10 and FIG. 11, in which the living-hinge members 1000 are particularly experiencing bending at the junctions 1008 as well as proximate the circumferential locations 1110 and 1112 and in which portions of those living-hinge members between those junctions and locations take on the sloped form of the ramp portions 1104 and 1106, are not the natural (e.g., unstressed) configurations of those living-hinge members. Rather, the configurations of the living-hinge members 1000 shown in FIG. 10 and FIG. 11 are taken on by those living-hinge members particularly because the AV tube 910 and enclosure 912 are sufficiently close to one another that the living-hinge members are compressed between those structures.

Relatedly, it should be appreciated that, if the AV tube 910 and enclosure 912 are retracted apart from one another, the living-hinge members will progressively straighten. Ultimately, when the distance between the AV tube 910 and enclosure 912 increases to equal the full length of the living-hinge members 1000, each of the living-hinge members will have a configuration that is strictly linear between the respective circumferential locations 1110 and 1112 at which the respective living-hinge member is connected to the AV tube and enclosure. That is, in such circumstance, the living-hinge members 1000 will no longer have bending at or proximate to the junctions 1108 and circumferential locations 1110 and 1112, and will not have sloped portions corresponding to the ramped portions 1104 and 1106.

Additionally, it should be recognized from FIG. 10 and FIG. 11 that the living-hinge members 1000 (which are intended to be shown relative to the annular elastomeric formation 900 in a ghosted or phantom manner) are surrounded by and encapsulated (or substantially encapsulated) within the annular elastomeric formation 900. That is, the annular elastomeric formation 900 is formed in relation to the AV tube 910, the enclosure 912, and the living-hinge members 1000 so as to extend between and fill in the gaps between the AV tube 910, the enclosure 912, and the living-hinge members 1000. In particular, none of the living-hinge members 1000 is positioned radially outwardly, relative to the center line 1002 of the improved mounting assembly 908, so as to extend radially outwardly beyond the annular elastomeric formation 900. Rather, the annular elastomeric formation 900 by itself forms the outer circumference of the overmolded section 914, including the living-hinge members 1000 thereof.

As with the springs 400, it should be recognized that the living-hinge members 1000 provide a redundant coupling mechanism by which the AV tube 910 and enclosure 912 are linked, so as to supplement the coupling provided by the annular elastomeric formation 900. That is, although it is intended that the annular elastomeric formation 900 serve as the primary support structure linking the AV tube 210 and the enclosure 212 in the improved mounting assembly 908, the living-hinge members 1000 can serve a backup support structure. Consequently, although the annular elastomeric formation 900 will serve as the primary weight bearing structure allowing for any weight coupled to the enclosure 912 (e.g., the disposer assembly 204 with the food waste disposer 206) to be borne by the AV tube 910 (and any structure supporting the improved food wasted disposer assembly 200 such as the sink 202), the springs 1000 can also provide such support. This can be beneficial, for example, if over time the annular elastomeric formation 900 experiences creeping or becomes distended, or if for some reason the annular elastomeric formation itself ceases to fully or substantially couple the AV tube 910 with the enclosure 912 (for example, if adhesive used to link the annular elastomeric formation 900 with the AV tube or enclosure weakens).

The assembly or manufacturing process by which the improved mounting assembly 908 is formed can be similar to that discussed above in regard to FIG. 8. In particular, the assembly process will include a step corresponding to the first step 804, at which a mounting subassembly including the AV tube 910, enclosure 912, and living-hinge members 1000 are integrally formed. Additionally, the assembly process will include a step corresponding to the fourth step 810, at which application of an elastomer or overmolding occurs, so that the annular elastomeric formation 900 is provided and the overall improved mounting assembly 908 is formed. It should be mentioned that, although the living-hinge members (having reduced thickness) 1000 can have an included angle of less than 180 degrees to reduce transmission of vibration and sound, but also the initial (as molded) support included angle may be altered during the elastomer overmolding process (to aid in processing). Following the overmolding, a post-overmolding state of the improved mounting assembly 908 is achieved, at a step corresponding to the fifth step 812 and, after this occurs, a load (such as the food waste disposer 206) can be applied to the improved mounting assembly, at a step corresponding to the step 816.

Notwithstanding the above similarities between the assembly processes for the improved mounting assemblies 908 and 208, the steps of FIG. 8 relating to determining or applying pre-loading (e.g., the steps 806 and 808), or achieving a post-overmolding state of the mounting assembly that may be influenced by such pre-loading, can be absent from the assembly process for the improved mounting assembly 908. In the initial overmolded state, the living-hinge members 1000 typically will be bent as described above in regard to FIG. 10 and FIG. 11 (e.g., at the junctions 1108). With such a bent configuration, the living-hinge members 1000 will not be significantly loaded in tension, and as a result will not transmit a significant amount of vibration between the enclosure 912 (and any structure coupled thereto, such as the food waste disposer 206) and the AV tube 910. However, given such a bent configuration and given that the living-hinge members 1000 are intended to be highly flexible in terms of such bending, the living-hinge members after being overmolded will impart little, if any, force with respect to the AV tube 910, enclosure 912, or annular elastomeric formation 900. Thus, pre-loading as can be achieved way of the springs 400 is not generally achieved by way of the living-hinge members 1000, and so little or no post-overmolding compression or tension offset effects are achieved via any such pre-loading relating to the living-hinge members 1000.

The above-described embodiments relating to FIGS. 2 through 11 entail some example embodiments of improved mounting assemblies encompassed herein, in which backup support linkages are provided to supplement the coupling between an AV tube (such as the AV tubes 210 or 910) and an enclosure (such as the enclosures 212 or 912) that is afforded by way of an anti-vibration linkage (such as the annular elastomeric formations 300 or 900). It will be appreciated that, in each of these above-described embodiments, the backup support linkages (whether in the form of the springs 400 or living-hinge members 1000) are positioned radially-inwardly of the outer circumferences of the annular elastomeric formations 300 or 900 with which those springs or living-hinge members are substantially encapsulated. Nevertheless, the present disclosure is also intended to encompass embodiments having different arrangements as well, including arrangements in which the backup support linkages are positioned radially-outwardly of the outer circumferences of the annular elastomeric formations serving as the anti-vibration linkages.

Figure 12:
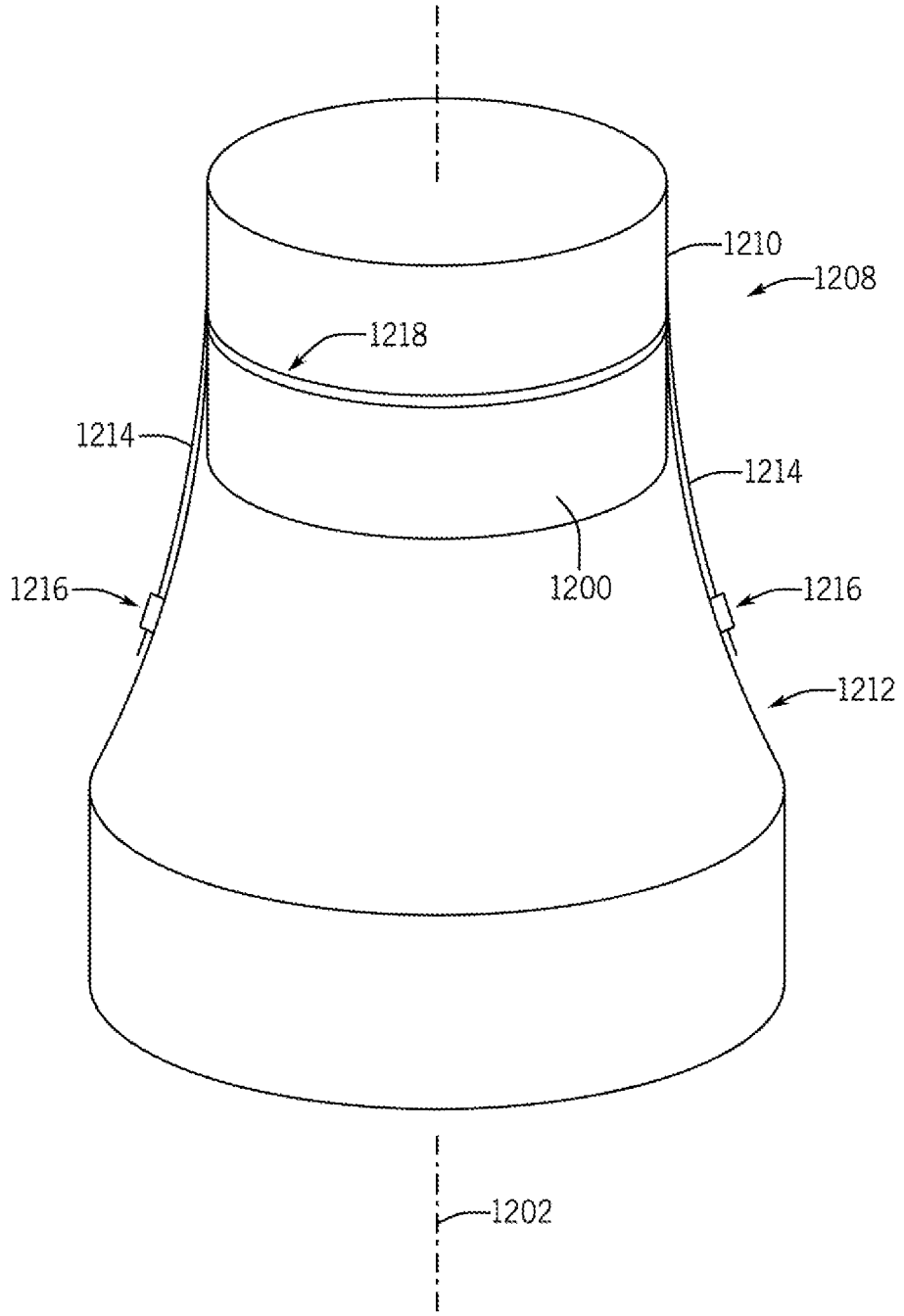
FIG. 12 is a front elevation view of cutaway portions of a third embodiment of the food waste disposer assembly represented by FIG. 2 including portions of a third improved mounting assembly, in which the improved mounting assembly includes a plurality of top-down external suspenders, an anti-vibration (AV) tube, and enclosure, and also including elastomeric material that forms a tension mount.

More particularly in this regard, FIG. 12 shows a perspective view of an additional alternate embodiment of an improved mounting assembly 1208. As with the improved mounting assembly 908, the improved mounting assembly 1208 can be implemented in a food waste disposer assembly that is identical or substantially identical to the food waste disposer assembly 200 of FIG. 2, except insofar as the improved mounting assembly 1208 is intended to take the place of the improved mounting assembly 208 (or improved mounting assembly 908) described above. As in the case of FIG. 3, FIG. 12 is particularly intended to show the improved mounting assembly 1208 apart from the sink 202 and the food waste disposer 206, so as to highlight several features of the improved mounting assembly.

Similar to the improved mounting assembly 208, the improved mounting assembly 1208 particularly includes an anti-vibration (AV) tube 1210 and an enclosure 1212. Again, the AV tube 1210 is configured to be mounted or coupled to the sink flange (or strainer flange) 216 of the sink 202 (discussed above). Also, the enclosure 1212 is positioned beneath and coupled to the AV tube 1210, and supports the food waste disposer 206, which is positioned beneath and coupled to that enclosure. Additionally, the improved mounting assembly includes an annular elastomeric formation 1200 positioned between and coupling the AV tube 1210 with the enclosure 1210.

Notwithstanding these similarities, improved mounting assembly 1208 differs from the improved mounting assembly 208 in that the annular elastomeric formation 1200 is not overmolded around backup linkages (such as the springs 400 or living-hinge members 1000), but rather is simply an annular elastomer that is coupled to and extends between, and is in tension between, the AV tube 1210 and enclosure 1212. Rather than employing any backup linkages (such as the springs 400 or living-hinge members 1000) that are positioned within or substantially encapsulated within the annular elastomeric formation 1200, instead the improved mounting assembly 1208 includes two suspenders (or suspender extensions) 1214 on the AV tube 1210 and two complementary features 1216 on the enclosure 1212.

As shown, the suspenders 1214 particularly are extensions that are integrally formed or molded as part of the AV tube 1210, and coupled to the AV tube at locations along an outer circumference 1218 of the AV tube (in this example embodiment, along a bottom rim of the AV tube to which the annular elastomeric formation 1200 is coupled). The suspenders 1214 particularly extend downward from the AV tube 1210, in a manner substantially parallel to (in this example, tapered slightly relative to) a central axis 1202 of the improved mounting assembly 1208 and alongside the outer circumference of the annular elastomeric formation 1200, to the complementary features 1216 of the enclosure 1212. The complementary features 1216 and suspenders 1214 are configured so that the suspenders 1214 can be secured or attached to the complementary features 1216 during assembly of the improved mounting assembly 1208.

In the present embodiment, the complementary features 1216 particularly include orifices into which and through which the suspenders 1214 are positioned during assembly of the improved mounting assembly 1208. All of the AV tube 1210, suspenders 1214, enclosures 1212, and complementary features 1216 are made of a common, meltable material (e.g., polymer plastic). Given this to be the case, the suspenders 1214 can be coupled to or locked in relation to the complementary features 1216 by way of heating, melting, and cooling the suspenders and complementary features, or heat staking the suspenders and complementary features relative to one another. In alternate embodiments, other locking features (e.g., complementary teeth) can be provided on the suspenders and complementary features such that the suspenders become locked in place relative to the complementary features upon being inserted therein. Regardless of the manner in which suspenders are coupled to complementary features, the coupling of the suspenders with the complementary features should be performed in a manner that leaves some slack in the suspenders, so as to avoid overly restricting (e.g., in terms of extension) the annular elastomeric formation 1200.

The process of assembling the improved mounting assembly 1208 can particularly involve two steps, namely, the applying of an elastomer in relation to the AV tube 1210 and enclosure 1212 so as to couple those structures, and coupling the suspenders 1214 to the complementary features 1216, with those two steps being performable in a simultaneous or sequential (in either order) manner. Although not shown, for aesthetic purposes, the improved mounting assembly 1208 can be further supplemented with an additional cylindrical (or substantially cylindrical) trim shell component or skirt that is slipped over the AV tube 1210 and positioned so as to surround and cover over the suspenders 1214 and complementary features 1216. Implementation of such a trim shell component can be considered an additional step of assembly.

Also, notwithstanding the above description concerning the embodiment of FIG. 12, the present disclosure is intended to encompass alternate embodiments having features that differ from those described above. For example, in some alternate embodiments, the improved mounting assembly can include more than two suspenders and more than two complementary features. Also, in some alternate embodiments, the suspenders can be integrally formed or attached to the enclosure (bottom enclosure piece) and the complementary features can be provided on the AV tube (top enclosure piece). Additionally, although in some embodiments the suspenders can be molded into the AV tube (or alternatively the enclosure), in other embodiments the suspenders can be attached to the AV tube (or enclosure) by way of a drop-on harness that seats on a ledge on the AV tube (or top enclosure piece), from which the suspenders dangle, or the suspenders can be attached to the AV tube (or top enclosure piece) by way of a zip/stake operation. Further, in some alternate embodiments, suspenders or extensions can be integrally formed or connected to each of the AV tube and enclosure, and corresponding (circumferentially-aligned) ones of the suspenders extending from the AV tube and enclosure can be coupled with one another at locations in between the AV tube and enclosure (e.g., alongside the annular elastomeric formation).

In view of the above description, it should be appreciated that the present disclosure is intended to encompass numerous embodiments of improved mounting assemblies for implementation in food waste disposer assemblies or other disposer assemblies. In at least some embodiments encompassed herein, the improved mounting assemblies allow for the grind chamber of the waste disposer, or associated enclosure, to be isolated from the sink by the use of an intermediate band of material (such as rubber or a thermoplastic elastomer) at or immediately below the neck or tube which connects to the mounting assembly (e.g., the AV tube). By employing the intermediate band of material, the improved mounting assemblies provide an anti-vibration (AV) feature with a tensile load. In addition, the improved mounting assemblies include backup linkages such as, for example, springs, living-hinge members, or suspenders, that serve to support the waste disposer, and/or associated enclosure, relative to the AV tube and sink to which it is mounted. Thus, an AV tension mount can be achieved by providing substrate support that reduces, adjusts, or offsets the tensile loading on the elastomeric component of the mount, and/or provides back-up support.

In at least some such embodiments, the improved mounting assemblies can be considered spring overmold-mount assemblies that (a) employ spring members to join the AV tube and enclosure to act with an overmold as a spring-and-elastomer suspension and damping system, and (b) optionally also involve pre-loading during the overmolding process to achieve an optimized in-service loading for the mount. That is, in at least some embodiments, a set of integral springs connects, and is molded together with, the AV tube and the enclosure. This mounting subassembly or substrate structure is then overmolded together with an elastomeric material (or other material), such as a thermoplastic elastomer (TPE). The springs provide backup support in terms of the coupling of the enclosure—and structure(s) attached thereto, such as a food waste disposer—to the AV tube (and therefore to the sink or any other structure to which the AV tube is attached). The substrate springs would optionally allow a pre-load (in tension or compression) to be applied at the time of the overmolding process. This permits the TPE or other overmold material to be influenced with regard to its loading during post-installation service, with the potential to offset at least some of a food waste disposer or other unit's weight or achieve an optimal state for performance and structural integrity. Depending upon the embodiment, the geometries and number of springs can be set or iterated to optimize the anti-vibration performance of the spring-overmold mount.

Also, in at least some other embodiments, multiple sets of living-hinge members (or living hinges with reduced thickness) and rigid member pairs connect, and are molded together with, the AV tube and the enclosure. That combined subassembly (and particularly the living-hinge members) are then overmolded with an elastomeric material or other material (such as TPE). The overmolding is performed in a manner such that the living-hinge members are not significantly loaded in tension and will not transmit a significant amount of vibration, yet provide back-up support for the AV mount to reduce or eliminate disadvantages that can arise if the elastomeric material creeps in tension. Again, the geometry of these living-hinge members (as with the springs discussed above or other substrate members), including their orientation/loading during the overmolding process, or both, can be iterated or adjusted to optimize the AV performance and the forces acting on the elastomeric mount feature.

Further, in at least some additional embodiments, the improved mounting assemblies employ external-support alternatives. Such improved mounting assemblies again can include an annular elastomeric formation or other structure that links the AV tube and enclosure and is intended to prevent or reduce the amount of vibration communicated between the AV tube and enclosure, and can again include backup linking structures that couple, and are integrally formed or molded in relation to, one or both of the AV tube and enclosure. However in contrast to embodiments in which springs, living hinges, or other backup linking structures connecting the AV tube and enclosure are positioned or substantially encapsulated within an overmolded structure, the backup linking structures in such external-support alternatives are positioned radially outward and/or radially inward (or otherwise externally) from the location of any annular elastomeric formation or other structure formed from an elastomeric (or other) material that links the AV tube and the enclosure. For example, such external-support alternatives can employ, as the backup linking components (or backup support linkages), suspenders (and possibly complementary features) that are integrally formed in relation to one or both of the AV tube and the enclosure. Also for example, depending upon the embodiment, the backup linking structures can be offset relative to, or in-line with, areas where a substrate wall is already produced by existing tooling.

As already discussed in regard to FIG. 12, in some such external-support alternatives, backup linking components are positioned radially outward of an annular elastomeric formation (e.g., alongside, or spaced-apart from but proximate to, an outer circumference of the annular elastomeric formation)—as in the case of the suspenders 1214 extending downward alongside the outer circumference of the annular elastomeric formation 1200 of the improved mounting assembly 1208. However, in some other external-support alternatives, backup linking components such as suspenders, springs, or living-hinge members are positioned radially inward of such an annular elastomeric formation (e.g., alongside, or spaced-apart from but proximate to, an inner circumference of the annular elastomeric formation)—in such embodiments, the elastomer is radially outward of the backup linking components (or linking structures) without substantially encapsulating them. To achieve such an arrangement, and particularly the desired elastomeric formation in such an arrangement, the shutting off of the formation of the overmold on the inside can in some cases be achieved by way of a collapsing core on the overmold tool. Further, to avoid or reduce the potential for entrapment of food particles or other material along/within the backup linking components, in some cases a secondary sleeve or insert can be positioned along or near those backup linking components. For example, in some such cases, such a secondary sleeve or insert can be heat staked to the AV tube above the backup linking components and hang down past the backup linking components in the form of a shield or curtain (e.g., hang down radially inward of the backup linking components such that the backup linking components are radially in between such a shield or curtain and the annular elastomeric formation), so as to prevent or reduce the entry of food debris or other material to the locations of the backup linking components.

Additionally, the present disclosure is also intended to encompass other embodiments employing one or more other types of linking structures for coupling an AV tube and enclosure that are positioned externally of an annular elastomeric formation or similar structure serving as an anti-vibration link between the AV tube and enclosure, including for example, springs or rods. Such additional linking structures can for example be employed in combination with any of the suspenders, springs, living hinges, or other backup linking structures described above. For example, in some embodiments encompassed herein, an AV tube and enclosure are coupled by one or more backup linking structures that are overmolded (such as the springs 400 or living-hinge members 1000) and additionally by one or more other backup linking structures that are externally positioned relative to any annular elastomeric formation or other anti-vibration coupling structure.

In view of above description, it should be appreciated that one or more of the embodiments of improved mounting assemblies or food waste disposer assemblies disclosed or encompassed herein can be advantageous in one or more respects. For example, in at least some embodiments encompassed herein, backup linkages linking an AV tube and enclosure (or linking top and bottom enclosure pieces) can support the weight of a food waste disposer or other unit or structure attached (at least indirectly) to the enclosure, without having to entirely rely on the performance or creep resistance of any anti-vibration structure(s) (e.g., an annular elastomeric formation or other structure formed from TPE or other elastomeric material) that are normally employed (in tension) to couple the AV tube and enclosure. Further, in at least some embodiments encompassed herein, the backup linkages are integrally formed or molded in relation to one or both of the AV tube and enclosure, so as to form a one-piece substrate. The primary linkage(s) between the AV tube and enclosure, which are intended to be formed from TPE or another elastomeric material (or other material suitable for providing an anti-vibration link), can be formed by a separate molding, casting, injection, or overmolding step.

Formation of the backup linkages in this manner can the facilitate manufacture of the improved mounting assembly, through the reduction of parts count or processing steps. Among other things, these manners of forming improved mounting assemblies can reduce or minimize the number of enclosure molds required for the project (e.g., by avoiding part-specific back-up tooling), can serve to enhance or maximize the flexibility to meet manufacturing/production shifts in a "mix" of products (since any mold can produce enclosures of a variety of types), and can generally serve to maximize an opportunity for there being commonality (in terms of a common manufacturing platform or process setup) at an as-molded stage.

Also, in at least some embodiments encompassed herein, the anti-vibration structure(s) employed to couple the AV tube and enclosure can be implemented by way of an overmolding process, such as through the overmolding of TPE or another elastomeric material (or other material suitable for providing an anti-vibration link), where the anti-vibration structure(s) are overmolded around one or more of the backup linkages. Such overmolded embodiments can be advantageous in one or more respects, including that the primary, anti-vibration linkage and the backup linkage structure(s) form an integrated package that is simple, elegant, and can avoid the interposition of debris between the different linkage structures.

Also, in at least some embodiments, such as where the backup linkages are springs, the backup linkages can be formed in a manner that introduces pre-loading, which can in some circumstances or embodiments introduced added or reduced levels of tension or compression to the overall overmolded structure after overmolding has occurred. Such added or reduced levels of tension or compression are configurable based upon the pre-loading, and can be introduced in a variety of manners that are intended to foster desired behavior, or enhance the longevity of operation, of the improved mounting assembly or portions thereof (e.g., to reduce the progression of creeping of the primary, ant-vibration linkage structure(s)), or to permit additional support for unit(s)/structure(s) (e.g., food waste disposers) that will be supported by the mounting assembly.

Indeed, in at least some such embodiments, the substrate springs can allow some degree of pre-loaded tension or compression to be applied at the time of the overmolding process, if desired. Such pre-loading will result in an interim post-overmolding state to which the TPE or other such damping material is subjected when the preload is relaxed, and another state once the system is permanently loaded by the unit weight upon installation and during its service life. If a desired state of in-service overmold tension or compression can be identified (e.g., based on analysis and/or the testing of different iterations), then—taking the unit's weight into account—the corresponding preload to attain that state can be calculated and designed into the overmold tooling/process. Further, even if processing or other limitations may make it difficult, in practice, to achieve or closely hold a particular desired state, it may be possible to use a degree of preloading during overmolding to at least hedge against an undesirable in-service state.

Also, at least some embodiments encompassed by the present disclosure can be advantageous in terms of the configurability of the mounting assemblies that is permitted, and/or the relevant simplicity with which the mounting assemblies can be manufactured, and/or the extent to which the same or substantially similar manufacturing machinery, tooling, or processing can be employed to manufacture/assemble a variety of different types or configurations of mounting assemblies. For example, in at least some embodiments in which the AV tube (or neck section of the substrate) can attach to the enclosure (or container body portion of the substrate) via a set of integral springs, such embodiments can be advantageous in that there are easy-to-implement manners of producing opposing pairs of springs (each pair by a different mechanism, due to the action of the tooling)—further for example, up to four essentially-similar springs in total. The cross-section of the springs can be configured to allow overmolding material (e.g., TPE) to flow into and fill the AV tube (or neck area of the part), during overmolding.

Some such arrangements are further advantageous in that the mounting assemblies can be manufactured/assembled using one or more manufacturing machines or techniques that are common both to such mounting assemblies employing anti-vibration linkage(s) and possibly other types of mounting assemblies. For example, a manner of manufacturing an improved mounting assembly with anti-vibration linkage(s) in combination with springs allows for a common gating system to be employed during manufacture, where the common gating system can be employed both for manufacturing the improved mounting assemblies with the anti-vibration linkage(s) (AV-mount mounting assemblies) and also for manufacturing other mounting assemblies that do not include such anti-vibration linkage(s) and can be considered rigid mounting assemblies.

Also, in at least some embodiments, the width or other geometrical attributes of the springs can be iterated (e.g., in prototype production and testing) in order to adjust the overall stiffness or system performance). Additionally, such an arrangement can be advantageous in that it is adaptable, and particularly is consistent with the addition of other substrate features in this area (e.g., between the AV tube and enclosure) as can be appropriate in certain embodiments or circumstances. For example, in a circumstance where a reduced number of springs, or springs of significantly reduced width or cross-section, would be appropriate to achieve desired system stiffness/AV performance—or if a fill analysis determined additional flow was needed—then temporary bridges could be molded in place to augment the flow and then subsequently removed. The overmold would then be applied around, outside, and/or between the springs to seal off the remaining gap area. The molder's production transition from the AV-mount (substrate) version to the rigid version (non-overmolded) would require only an insert or slide change. The overmolding step can be varied according to the requirements of the design.

It is specifically intended that the present invention not be limited to the embodiments and illustrations contained herein, but include modified forms of those embodiments including portions of the embodiments and combinations of elements of different embodiments as come within the scope of the following claims.

We claim:

1. A mounting system for mounting a waste disposer, the mounting system comprising:

a tubular structure extending between first and second ends;

an enclosure structure having an additional end, wherein the enclosure structure is configured to be able to support, at least indirectly, the waste disposer;

an elastomeric member extending between the second end and the additional end, wherein the elastomeric member is coupled to each of the tubular structure and the enclosure structure, and serves to couple the tubular structure and the enclosure structure; and a plurality of backup linkage members, wherein each of the plurality of backup linkage members is coupled at least indirectly to each of the tubular structure and the enclosure structure, and couples at least indirectly the tubular structure and the enclosure structure, and wherein each of the plurality of backup linkage members is integrally formed or molded with at least one of the tubular structure and the enclosure structure.

2. The mounting system of claim 1, wherein the elastomeric member is an annular elastomeric member that is coupled to a first annular rim of the tubular structure at the second end, and also coupled to a second annular rim of the enclosure structure at the additional end.

3. The mounting system of claim 1, wherein the elastomeric member is made of a thermoplastic elastomer (TPE) material and serves to prevent or reduce a communication of vibration between the enclosure structure and the tubular structure.

4. The mounting system of claim 1, wherein each of the tubular structure, the enclosure structure and the plurality of backup linkages is made of a polymer plastic material differing from an elastomeric material of the elastomeric member.

5. The mounting system of claim 1, wherein each of the plurality of backup linkage members is integrally formed or molded with both of the tubular structure and the enclosure structure, and extends between the tubular structure and the enclosure structure.

6. The mounting system of claim 5, wherein the elastomeric member is overmolded around the plurality of backup linkage members.

7. The mounting system of claim 6, wherein each of the backup linkage members is substantially surrounded by and encapsulated within the elastomeric member.

8. The mounting system of claim 6, wherein the plurality of backup linkage members includes a plurality of springs.

9. The mounting system of claim 8, wherein each of the springs includes a respective first ramp portion and a respective second ramp portion that are joined at a respective junction.

10. The mounting system of claim 9, wherein each of the first ramp portions of the respective springs extends in a first inclined direction from a respective first circumferential location along a first annular rim of the tubular structure at the second end to the respective junction of the respective spring, and wherein each of the second ramp portions of the respective springs extends in a second inclined direction from the respective junction of the respective spring to a respective second circumferential location along a second annular rim of the enclosure structure.

11. The mounting system of claim 10, where the plurality of springs includes either two of the springs or four of the springs.

12. The mounting system of claim 8, wherein the elastomeric member experiences either a compression or a tension, even though the waste disposer is not supported by the elastomeric member, due to a either a pre-load tension force or a pre-load compression force having been imparted to one or more of the springs.

13. The mounting system of claim 12, wherein the elastomeric member experiences the compression when the waste disposer is not supported by the elastomeric member, but the compression changes to an additional tension upon the waste disposer becoming supported by the enclosure structure.

14. The mounting system of claim 6, wherein the plurality of backup linkage members includes a plurality of living-hinge members.

15. The mounting system of claim 1, wherein the plurality of backup linkage members includes a plurality of suspenders that are integrally formed or molded with the tubular structure, and further comprising a plurality of complementary features formed on the enclosure structure, wherein the respective suspenders are coupled to the respective complementary features.

16. The mounting system of claim 1, wherein a portion of the tubular structure at or proximate the first end is configured to be coupled to and supported by, at least indirectly, a sink, and the waste disposer is a food waster disposer.

17. A waste disposer assembly comprising:

a waste disposer;

a mounting assembly including a first structure having a first end and a second end, and configured to be coupled at or proximate the first end to a support structure;

a second structure having an additional end, wherein the waste disposer is at least indirectly attached to and supported by the second structure;

an anti-vibration linking structure extending between and coupling the second end and the additional end; and a plurality of supplemental linking structures coupling the first structure and the second structure, wherein each of the supplemental linking structures is integrally formed or molded with respect to each of the first structure and the second structure, and wherein the anti-vibration linking structure is overmolded around, so as to substantially encapsulate, each of the supplemental linking structures.

18. The waste disposer assembly of claim 17 wherein the anti-vibration linking structure is formed from an elastomeric material, wherein each of the supplemental linking structures is either a spring or a living-hinge member, and wherein a channel extends through the first structure, the anti-vibration linking structure, and the second structure so that at least some waste material can proceed from the support structure to the waste disposer.

19. A method of assembling a mounting system for use in coupling a food waste disposer to a sink, the method comprising:

forming a mounting subassembly including a tubular structure, an enclosure structure, and a plurality of first linking structures, wherein all of the tubular structure, the enclosure structure, and first linking structures are formed integrally;

applying an elastomeric material to the mounting subassembly, so as to provide an elastomeric formation extending between the tubular structure and the enclosure structure, and so as to couple the enclosure structure with the tubular structure;

wherein the elastomeric formation serves as a primary linking structure by which the enclosure structure is supported in relation to the tubular structure, and the first linking structures are backup linking structures, and wherein the elastomeric formation is configured to prevent or reduce a communication of vibrations between the tubular structure and the enclosure structure.

20. The method of claim 19, further comprising:

applying a pre-load to the mounting subassembly prior to the applying of the elastomeric material, wherein the pre-load is either a compression pre-load or a tension pre-load, wherein a state of the mounting system is achieved subsequent to the applying of the elastomeric material in which the elastomeric formation is in tension or compression as influenced by the pre-load.

* * * * *